US005281960A

United States Patent [19]

Dwyer, III

[11] Patent Number: 5,281,960

[45] Date of Patent: Jan. 25, 1994

[54] HELMET MOUNTED DISPLAY

[75] Inventor: Eugene J. Dwyer, III, New York, N.Y.

[73] Assignee: Silhouette Technology, Inc., Morristown, N.J.

[21] Appl. No.: 794,863

[22] Filed: Nov. 19, 1991

[51] Int. Cl.[5] ..... G09G 3/20

[52] U.S. Cl. ..... 345/31; 345/8; 345/15; 345/115

[58] Field of Search ..... 340/705, 795, 794, 796, 340/781, 754, 755, 762, 702; 358/103, 93, 901; 359/230, 245, 618

[56] References Cited

U.S. PATENT DOCUMENTS

| | | | |
|---|---|---|---|
| 1,992,009 | 4/1929 | Kell | 178/6 |
| 4,153,913 | 5/1979 | Swift | 358/93 |
| 4,311,999 | 1/1982 | Upton et al. | 340/755 |
| 4,315,241 | 2/1982 | Spooner | 340/705 |
| 4,322,726 | 3/1982 | Collier et al. | 340/705 |
| 4,427,977 | 1/1984 | Carollo et al. | 340/795 |
| 4,543,601 | 9/1985 | Harada et al. | 358/213 |
| 4,595,954 | 6/1986 | Endo et al. | 358/213 |
| 4,612,581 | 9/1986 | Endo et al. | 358/213 |
| 4,633,317 | 12/1986 | Uwira et al. | 358/213 |
| 4,652,928 | 3/1987 | Endo et al. | 358/213 |
| 4,755,876 | 7/1988 | Dangler | 358/264 |
| 4,831,370 | 5/1989 | Smoot | 340/755 |
| 4,897,715 | 1/1990 | Beamon, III | 358/93 |
| 4,910,413 | 3/1990 | Tamune | 250/578.1 |
| 4,920,418 | 4/1990 | Robinson | 358/213.28 |
| 4,934,773 | 6/1990 | Becker | 350/6.6 |
| 5,018,007 | 5/1991 | Lang et al. | 358/901 |
| 5,040,058 | 8/1991 | Beamon, III | 358/103 |
| 5,053,765 | 10/1991 | Sonehara et al. | 340/795 |
| 5,091,719 | 2/1992 | Beaman | 340/705 |

*Primary Examiner*—Alvin E. Oberley
*Assistant Examiner*—Xiao M. Wu
*Attorney, Agent, or Firm*—Antonelli, Terry, Stout & Kraus

[57] ABSTRACT

An optical display system is disclosed having a preferred application in a helmet mounted heads-up display. The display system includes an image source (42–46) for generating an image which includes a plurality o fields sequentially displayed by the image source to form the image with a two-dimensional array of pixels forming each field and the fields having a spatially modulated light intensity. An image display (50) is coupled to the image source for displaying the fields. The image display produces for each field a two-dimensional display having a fixed number of light emitting points (65) which are disposed along each dimension of the two-dimensional array with each light emitting point being spaced apart from adjacent light emitting points by a fixed distance. An actuator (52) is provided for moving the light emitting points in unison in a repeated pattern relative to a field of view of the displayed image with motion of each of the light emitting points along two axes during the repeated pattern delineating an area which is a fraction of an area of the displayed image produced by the image display. Movement of the light emitting points through successive positions of the repeated pattern is synchronized with the successive display of individual fields by the image source.

60 Claims, 19 Drawing Sheets

HELMET MOUNTED DISPLAY

TECHNICAL FIELD

The present invention relates to apparatus and a method of operating an image source which generates an image including a plurality of fields which are sequentially displayed and an image display coupled to the image source for displaying the fields which provides a high resolution visual display. More particularly, the present invention relates to apparatus and a method of operation of the foregoing type for use in a helmet mounted display.

BACKGROUND ART

Helmet mounted displays have been developed for diverse applications, such as simulation systems used for training, and for use in vehicular or aircraft operation as displays for sensor data and/or instrument readings, or as an aid to the operator of the vehicle or aircraft performing other tasks. For example, a helmet mounted display has been used to present data concerning weapon status to pilots of fighter aircraft. This data is often presented in alpha-numeric form and appears to reside or originate far in front of the aircraft but is actually generated by a display, often by a cathode ray tube (CRT), located in the users helmet. Special optics which are attached to the helmet bend and focus the display light to create the effect of a remote origin for the information. Locating the apparent origin of the display image in a position far in front of the aircraft, where the pilot's eyes are normally focused during aircraft operation, eliminates the need to look down and refocus onto the aircraft instrument panel. Thus, the pilot may retain a constant head-up attitude.

Other information, such as fuel level or engine temperature may be displayed in the same manner.

Images such as those discussed here which have an apparent position where no real image source exists are known as "virtual images". Images generated in this manner can range in complexity from simple cursors or cross hairs, to complete scenery with trees and mountains. The types of images which may be used for simulation or vehicle operation in helmet mounted head-up displays are diverse in nature.

In a helmet mounted head-up display the image source is generally located in or near a helmet worn by the user. Special optics, also located in or near the helmet, bend and focus light from the image source to create a virtual image of the display. Helmet mounting has the advantage of allowing the image source to move with the user. Also, a head-mounted display generally serves to present a larger image field, in part because the display and optics are closer to the user's eye.

FIG. 1 illustrates a helmet mounted head-up display 10 which may be equipped with a stereo image source and controller 12. The controller and image source 12 supplies imagery to one or both eyes through a fiber optic bundle (FOB) 14 which contains an array of individual fibers which transmit light to produce the display to the wearer 16 of the helmet 18 as viewed from the eyes of the wearer 20 of the helmet. A relay lens 22 couples the image from the FOB 14 to the eyes. In applications using virtual imagery, computer generated images are transmitted by the FOB 14 from the controller and image source 12. The virtual image is spatially overlayed onto normal real world scenery outside the helmet 18. Furthermore, it is possible to block out the real world scenery and allow the wearer of the helmet mounted head-up display to only view the virtual scenery generated by the computer.

Certain systems utilizing a helmet mounted head-up display detect the position or angle of the helmet. This information is used by the controller and image source to adjust the virtual scenery presented to the user with the goal being to shift the scenery in a realistic manner as the helmet moves.

Applications of helmet mounted head-up displays are only effective if the virtual imagery presented to the wearer of the helmet is realistic. Realism depends strongly on two factors which are the resolution or detail of the virtual image and the apparent size of the imagery. Resolution is normally measured by the size of the smallest point (usually called a "pel" or "pixel") which can be displayed. Higher resolution imagery features smaller pixels and appears more precise and contains more detail. The image size is a measure of the vertical and horizontal size of the virtual image as it appears to the viewer, and can be measured in angular degrees or radians. A larger image reduces tunnel vision and more closely duplicates normal viewing. In most instances, the resolution and size of a helmet mounted head-up display are limited by the resolution of the device used as the image source. Standard image sources are usually capable of presenting a fixed, limited number of image pixels. These pixels can be used to create a small, highly resolved image, or can be spread out to make a larger, but less detailed image. In either case, the number of pixels is generally fixed. It is usually the task of the designer of a helmet mounted head-up display to adjust the resolution and size so as to create the most favorable image for a particular application.

The limit on the number of pixels which may be used is due to basic limitations in the present display technology. For the presently favored CRT image source, the number of pixels which can be presented by the display is roughly calculated by dividing the area of the display by the area of the smallest pixel which can be presented. This calculation yields the number of pixels which can be packed into the display area. This number can be increased either by increasing the display area or by reducing the size of the pixels. Both of these practices have reached practical limits in present technology. The display area cannot be increased because the display size and weight become cumbersome for the head of the user of a helmet mounted head-up display to support. Basic CRT electron gun and phosphor technology limits further significant decreases in the size of the display pixels.

As a practical example, a typical CRT used in helmet mounted head-up displays may be one inch in diameter, 4.5 inches long and weigh about 6 ounces. The pixel size is typically about 0.001 inch and a complete display image may contain approximately 650,000 pixels. The pixels are nominally arranged as adjacent lines on the CRT faceplate. Image resolution is traditionally identified as the number of lines and the number of pixels-per-line which the display can support. Thus, a display resolution might be described as 875 lines by 875 pixels-per-line. State of the art helmet mounted displays can produce images of 1,500 lines at 1,500 pixels-per-line for a total of more than 2,000,000 pixels. As mentioned above, display performance can also be rated according to the maximum number of pixels which can be displayed. This number is often referred to as the "space-bandwidth product", and is the product of the number of display lines times the number of pixels-per-line.

Thus, the objective of greater image realism is effectively limited by the inability of the head to support larger, heavier displays. In response, designers of helmet mounted head-up displays have removed the CRT image source from the helmet area and used a coherent FOB as illustrated in FIG. 1 to convey remotely generated images to the helmet region. A coherent FOB preserves a fixed address between input and output pixels such that a first pixel of an image source coupled to a first fiber is coupled by the fiber to a first pixel at a corresponding position in an image display. The spatial order of the image pixels is thus maintained during transmission. When the CRT is remotely located off the helmet, the CRT size can be increased to produce more highly resolved and sometimes brighter images which serve to increase the realism of the image.

The fiber optic bundle is constructed as an array of glass or plastic fibers which can each convey one unit of image information from the image source (CRT) to the helmet for display to the wearer of the helmet. To work effectively, the FOB must include a number of fibers equal to or exceeding the number of CRT pixels. Thus, in high resolution applications, the number of fibers in the bundle may exceed 2,000,000 (1,500 lines×1,500 pixels/line image source). In this case, if each individual fiber is 50 microns in diameter, the fiber bundle will be almost two inches in diameter. Due to the large number of individual fibers, such a bundle is almost impossible to manufacture without defects, is expensive, and generally represents a greater head weight than the head-mounted CRT it replaces. Weight considerations are particularly important in applications where high accelerations can radically increase the effective weight of the bundle and helmet. Such applications include helmet-mounted displays used in high performance aircraft. For these reasons, the approach of remotely locating the image source by using a fiber optic bundle has limited utility in high resolution applications.

Thus, current state of the art helmet mounted head-up displays demonstrate limited realism due to a limited image source space bandwidth product. Although designers realize the benefits of a higher resolution and larger imagery in helmet mounted head-up displays, no present technology is available to meet this need when considered from the perspective of the expense of manufacturing, reliability and weight of the necessary fiber optic bundle connecting a remote image source to the helmet of the helmet mounted head-up display especially for applications where high acceleration induced forces are expected, such as in high performance aircraft, or where mobility is required.

U.S. Pat. 4,897,715 discloses a helmet display in which a 1×n array of fiber optic fibers is deflected across the width of the viewing field to produce a stereoscopic image within the field of view (FOV) of the wearer of the helmet. The system of the '715 patent relies upon each fiber in the 1×n array scanning a plurality of lines within a predetermined area of the display as viewed from the FOV with the stated example being 125 lines. This system suffers from the disadvantage of requiring the deflection of the fiber optic ribbon across the total width of the display FOV, which presents substantial problems in the control of the motion sweeping the image produced by the 1×n array of fibers across the width of the image FOV and further adds to the expense of the system. For example, the '715 patent discloses that the resultant image has dimensions by 11.2 mm in the vertical direction and 15.4 mm in the horizontal direction. As a result, the deflection system for sweeping the 1×n array through the width of the display must cause a physical displacement of the light outputted by the array of fibers through a physical dimension which produces the width of 15.4 mm at the FOV. This large amplitude of motion presents difficult control problems which add expense to the display.

Image pick-up systems are known using image pickup devices such as charge coupled devices (CCDs) which either physically move the CCD array or optically move the optical image coupled to the CCD array to increase the resolution of the sensed pixels. These systems permit the production of a higher resolution video image beyond the resolution of individual CCD fabrication technology by moving the array and/or light coupled to the array. U.S. Pat. Nos. 4,543,601, 4,595,954, 4,612,581 and 4,652,928 disclose image sensing devices in which image sensing elements are physically moved relative to the object being scanned to provide a higher resolution sensing of pixels in the image than the physical resolution of the image sensing elements in the array which is used. Furthermore, U.S. Pat. Nos. 4,633,317, 6,755,876, 4,910,413 and 4,920,418 disclose image sensing devices in which the optical image is moved relative to the image sensing array to provide higher resolution of the sensed image than the resolution of the individual sensing elements within the array.

None of these patents discloses maintaining synchronism between the image sensing device and an image display with the image display producing a high resolution output by synchronizing the generation of successive fields of the image with the production of relative motion between an array of light emitting points by an image display as viewed from a FOV through successive positions which are synchronized with the generation of successive fields by the image sensing device.

U.S. Pat. Nos. 4,311,999 and 4,831,370 disclose displays in which a linear array of optical fibers is physically scanned across the width of scanning lines. These systems are analogous to the scanning produced by U.S. Pat. No. 4,897,715 described above.

U.S. Pat. No. 4,934,773 discloses a display in which a linear array of light emitting diodes (LEDs) is optically scanned across the entire width of the display.

U.S. Pat. No. 1,992,099 discloses a display device in which a disk containing a plurality of lenses is rotated by a motor to scan light from three light sources to produce a composite display.

DISCLOSURE OF INVENTION

The present invention is a method of operation and an optical display system which provides an increased image space-bandwidth product of a displayed image which is viewed from a field of view (FOV) without increasing the image source resolution. The apparent resolution of the displayed image is increased without increasing the resolution or size of the display source used to generate the image. With the invention, an array of light emitting points with a fixed spacing is moved in unison or with an apparent relative motion in a repeated pattern relative to a FOV of the displayed image. The motion of each of the light emitting points in two dimensions in the repeated pattern delineates an area which is a fraction of an area of the displayed image produced by the image display. The motion or apparent motion of the array of light emitting points in the repeated pattern through successive positions within the repeated pattern is synchronized with the successive display of individual fields by the image source. In other words, an image source, which may be any known type of image source such as, but not limited to, spatially or time multiplexed CRTs, a solid state display panel such as an array of LEDs or an array of cells in an LCD display, produces successive fields of an image. The relative motion or apparent motion produced between the FOV and the array of light emitting points steps through a plurality of identifiable positions which are synchronized in time with the displaying of successive fields of information by the image source. While a preferred application of the present invention is in a helmet mounted head-up display, it should be understood that the present invention permits a high resolution display with a high space bandwidth product to be generated for diverse applications using a lower resolution array display of light emitting points which produce a high resolution display having an apparent high number of pixels. The high resolution is produced by the product of the number of identifiable positions through which the array is stepped, which is equal to the number of fields produced by the image source, times the number of light emitting points of the display.

In a preferred application of the present invention, in a helmet mounted heads-up display, the present invention has the following advantages when compared to the prior art helmet mounted heads-up displays. A higher pixel count is produced at the image display as viewed from the FOV as a consequence of the time multiplexing of the pixels which are transmitted from the image source to the image display by the FOB. In other words, each fiber of the FOB carries a number of pixels during the display of an image by the image display which is equal to the number of fields which is equal to the number of positions in the repeated pattern of the array of light emitting points. Square pixels may be used when apertures of a mask have a square configuration. The helmet is lighter as a result of removing the image source and a lighter fiber bundle is produced with the reduction of the number of fibers by a factor equal to the number of fields which produces the weight reduction. The actual or apparent motion of the array of light emitting points by the actuator in two dimensions to produce the image display eliminates larger dimension scanning movement along one axis as in the prior art discussed above where movement occurs across the entire dimension (length or width).

The relative motion between the array of light emitting points and the FOV is produced by an actuator which has diverse implementations in accordance with the invention. An actuator as used herein includes any controlled element for producing relative, actual or apparent motion between an array of light emitting points and the FOV. Physical motion of the array is not necessary. Without limitation, examples of the actuator include piezoelectric devices and electromagnetically operated devices for causing the displacement of the array of light emitting points along orthogonal axes, or devices for reflecting, deflecting or refracting an optical image of the pixels produced by the image source through the plurality of positions viewed from the FOV of the image display to produce the array of light emitting points. The actuator causes the relative or apparent motion of the array of light emitting points, which extend in two dimensions and have at least two light emitting points disposed along each dimension with each light emitting point being spaced apart from adjacent light emitting points by a fixed distance, in a repeated pattern relative to the FOV of the displayed image. The motion of each of the light emitting points in two dimensions during the repeated pattern delineates an area which is a fraction of an area of the displayed image produced by the display as viewed from the FOV. As a result, the requirement in the prior art of moving an array of image producing devices along a total dimension of at least one axis of the display is eliminated which is one of the substantial disadvantages of the prior art.

The two-dimensional array of light emitting points may be produced in a number of different ways. The following examples are merely illustrative of different mechanisms for producing the two-dimensional array of light emitting points which have a fixed distance between each point. The array of light emitting points are moved in unison physically or by electronic or optical switching of an array of light valves through the repeated pattern to identified positions to produce the display from the FOV of the image display. A coherent or non-coherent array of fiber optic fibers may be formed into a bundle with the spacing between individual fibers which are fixed relative to each other in the bundle defining the spacing between the light emitting points as viewed from the FOV. The light emitting points are the ends of the fiber optic bundle which are optically coupled to the image display with an actuator physically moving the end of the fiber optic bundle coupled to the display through the repeated pattern in two orthogonal directions. A mask having a two-dimensional array of apertures, which may be manufactured from a material such as glass or plastic with the spacing being established by photolithographic or other manufacturing techniques permitting high tolerances in the spacing of the apertures to be achieved, is optically coupled to light produced by individual pixels of the image source to produce the array of light emitting points as viewed from the FOV. Physical motion of the mask and/or deflection, refraction or reflection of light outputted from the apertures of the mask may be used to produce relative motion between the light emitting points and the FOV of the image display. Additionally, the mask may be attached to the ends of the fiber optic bundle, which are optically coupled to the image display, to eliminate the difficult manufacturing requirement to produce high tolerance spacing in the positioning of the individual fiber optic fibers in the bundle to avoid the presence of artifacts in the image outputted from the fiber optic bundle which otherwise would degrade image quality. Preferably the diameter or largest dimension of the apertures of the mask is less than the diameter or largest dimension of the fiber so as to avoid registration problems when attaching the mask to the end of the fiber optic bundle to produce uniform spacing of the apertures which defines the spacing of the light emitting points when viewed from the FOV looking at the mask. Finally, an array of light valves or other selectively transmissive devices may be located between the image source and the image display which are selectively opened during successive fields of the display from the image source to cause apparent relative motion of the array of light emitting points through the successive positions of the repeated pattern which are synchronized with the successive fields of the image source.

The area delineated by the repeating pattern of each light emitting point has a length and a width which is normally an integer multiple of the diameter or dimension of the light emitting points. The position of each light emitting point during movement of the array of light emitting points through the repeated pattern moves sequentially in increments along the length or along the width equal to the diameter or dimension of the light emitting points in synchronism with successive fields displayed by the image source.

In a preferred application of the present invention in a helmet mounted head-up display, the fiber optic bundle performs the additional function of transmitting an input optical image from the external field of view of the helmet back along the fiber bundle to the position of the image source. This function utilizes the ability of optical fibers to carry light simultaneously in both directions along the fiber. The input image may be remotely analyzed to determine the direction in which a wearer of a helmet is looking or otherwise to determine some characteristic of the input image. An image analyzer analyzes the input image transmitted by the fiber optic bundle and controls transmitting an image from the image source which was generated in response to an analysis of the transmitted image by the image analyzer to the image display. The input image is preferably inputted from an optical system optically coupled to a FOV of the helmet with the transmitted image from the image source providing an enhancement of an object in the FOV of the helmet. Thus, an image of the external world or scene viewed by the helmet wearer can be coupled or projected onto the fiber bundle, and conveyed back along the fiber bundle to an image analyzer, which is programmed to detect or enhance some aspect of the analyzed image. The enhanced or analyzed image can be returned to the helmet wearer as a virtual image in accordance with the invention. In this way, certain aspects or characteristics of input imagery within the FOV of the helmet can be enhanced, high-lighted or otherwise interpreted for the benefit of the helmet wearer. The input image may include an infrared image from the FOV, an image of a moving object in the FOV or an image to be recognized by pattern recognition with the transmitted image from the image source enhancing the infrared image, the moving image or a recognized pattern inputted from the FOV of the helmet.

The image source used to form the display image may be from diverse sources. The image source may be from a plurality of spatially overlapping or non-overlapping image producing devices each optically coupled to the array of light emitting points such as, but not limited to, cathode ray tubes or solid state light producing arrays such as LEDs. The plurality of image producing devices may produce different colored images which are combined to produce a colored displayed image.

Preferably, the invention includes sensing a position of the actuator either by sensing the position of the actuator and/or the position of a fiber optic bundle or mask and controlling the movement of the actuator through the repeated pattern in response to the sensed position so as to control precisely the registration of the array of light emitting points at desired positions within the repeated pattern which are synchronized with specific fields inputted by the image source. A mechanism for sensing the position of the actuator may sense the position of the fiber optic bundle by utilizing an optical fiber which is coupled to a light source which outputs light onto a target area, which is fixed in position with respect to the FOV, having reflective areas and at least one output fiber having an input disposed adjacent to the output of the input fiber having an output coupled to a photosensitive device. The output from the photosensitive device occurs when the light output of the at least one input fiber projects light which is reflected by one of the reflective areas to the input of the at least one input optical fiber which is processed by the actuator to provide a signal indicating the position of the light emitting points to control the repeated pattern. The number of reflective areas is equal to a number of positions of the repeated pattern along one axis.

A look-up table may be used to store data of at least a transmission characteristic of individual fibers within a fiber optic bundle which are optically coupled to a pixel of the image source and a single light emitting point of the image display. The image source is responsive to the stored data to control a light intensity which is outputted by the image source to each fiber optically coupled to a pixel of the image source to provide at least a uniform light transmission characteristic for the fibers optically coupled to the light emitting points. The at least one stored characteristic includes a multiplicative factor which is used to control the light intensity of the pixels to at least normalize the transmissivity of the fiber bundle.

Uniformity in the spacing between the light emitting points may be controlled by the use of a mask having an array of spaced apertures. The apertures are uniformly spaced with an individual aperture being optically coupled with an individual pixel of the image source so that light emitted from one pixel passes through the aperture to the FOV to provide spacing between the light emitting points as viewed from the FOV which is defined by spacing between the apertures.

An optical display system in accordance with the invention includes an image source for generating an image which includes a plurality of fields sequentially displayed by the image source to form the image with a two-dimensional array of pixels forming each field and the fields having a spatially modulated light intensity; an image display, coupled to the image source, for displaying the fields and including for each field a two-dimensional array having a fixed number of light emitting points with at least two light emitting points being disposed along each dimension of the two-dimensional array and each light emitting point being spaced apart from adjacent light emitting points by a fixed distance; and an actuator for moving the light emitting points in unison in a repeated pattern along two axes relative to a field of view of the displayed image with motion of each of the light emitting points along two axes during the repeated pattern delineating an area which is a fraction of the area of the displayed image produced by the image display and moving of the light emitting points through the successive positions of the repeated pattern being synchronized with the successive display of individual fields by the image source. The motion of the light emitting points in each of the two dimensions defining the area of the repeated pattern is through a plurality of the successive positions in displaying the fields of the image. The image source may comprise a cathode ray tube which modulates the light intensity of the spatially modulated fields with each field being comprised of an array of pixels which are sequentially scanned by the cathode ray tube. The area delineated by the motion of each light emitting point during the repeated pattern has a length of AX and width of BX with a cross-sectional area of $ABX^2$ with A being an integer equal to or greater than 2, B being an integer equal to or greater than 2 and X being a dimension (diameter) of the light emitting points with a position of each light emitting point during movement of the array of points through the repeated pattern by the actuator moving a distance equal to AX along the length or BX along the width in synchronism with successive fields displayed by the image source. The invention further includes a fiber optic bundle having a plurality of individual fibers for transmitting light from the pixels of the image source to the light emitting points of the image display with an individual optical fiber of the bundle which is optically coupled to a pixel transmitting light between a pixel and a light emitting point. The actuator moves an end of the fiber optic bundle coupled to the image display with the individual fibers of the end being spaced apart by the fixed distance. Alternatively without limitation, the actuator may refract, reflect or deflect light emitted from ends of the fiber optic bundle to produce the apparent effect of motion of the light emitting points through the repeated pattern.

In a preferred application of the present invention, the image display is part of a helmet mounted head-up display movable relative to the image source and provides images to be visually observed by a person wearing the helmet. The fiber optic bundle additionally transmits an input optical image from the helmet to the image source position and further includes an image analyzer for analyzing the input image transmitted by the fiber optic bundle in controlling transmitting an image from the image source which is generated in response to an analysis of the transmitted image by the image analyzer. The input image is inputted from an optical system optically coupled to a FOV of the helmet and the transmitted image from the image source to the helmet is an enhancement of an object in the FOV of the helmet. The input image may include an infrared image, an image of a moving object or a pattern to be recognized in the FOV of the helmet and the transmitted image from the image source enhances the infrared image moving object or recognized pattern in the FOV of the helmet. A mask having an array of spaced apertures with an individual aperture being optically coupled to an individual fiber so that light emitted from one optical fiber passes through the aperture provides a spacing between the light emitting points as viewed from the FOV which is defined by a spacing between the apertures with the mask being moved by the actuator through the repeated pattern to display the image. The diameter or largest dimension of the apertures is smaller than a diameter or largest dimension of an end of each fiber which is attached to the image display.

The actuator may take diverse forms. At least one pair of piezoelectric or electromagnetic elements, such as voice coils, may be used for moving the light emitting points along orthogonal axes to produce the repeated pattern. Alternatively, an actuator may comprise at least one lens optically coupled to a light output of the light emitting points at the image display for deflecting the light output along orthogonal axes, a mirror for reflecting the light output or electronically controlled refracting devices to produce the repeated patterns.

The image source may comprise a plurality of image producing devices with each device providing a part of each field with the parts being spatially non-overlapping or the plurality of image producing devices may provide a different input image with the input images being spatially overlapping. The spatially overlapping images may be different colored images which are combined to produce a color displayed image.

A mechanism is provided for sensing a position of the fiber optic bundle at an end optically coupled to the light emitting points or, alternatively, for sensing the position of the actuator or a mask for establishing the spacing between the light emitting points alone or by connection to the end of the fiber optic bundle coupled to the image display. The mechanism for sensing may comprise at least one input fiber of the bundle coupled to a light source and having an output which outputs light onto a target area which is fixed in position with respect to the FOV having reflective areas and at least one output fiber having an input disposed adjacent to the output of the input fiber having an output coupled to a photosensitive device. An output from the photosensitive device occurs when the light output of the at least one input fiber projects light which is reflected by one of the reflective areas to the input of the at least one output optical fiber which is processed to provide a signal indicating the position of the light emitting points to control the repeated pattern.

The image source and the image display are fixed relative to each other and are not movable physically relative to each other. In one embodiment of the invention, the actuator may comprise an array of light valves disposed between the image source and the field of view with a number of light valves being equal to the fixed number of light emitting points with individual light valves being aligned with a single pixel and containing an array of apertures which each respectively correspond to a different position of a single light emitting point with each aperture being switchable to pass light from the aligned pixel and a controller synchronizes the display of the fields and the switching of the apertures to produce movement of the light emitting points through the repeated pattern with each successive position of a light emitting point corresponding to a different field of the image source. In another embodiment of the invention, the image source comprises a light source, a filter which sequentially filters light produced by the light source with each sequential filtration filtering the light with a comb filter-like characteristic having spaced apart pass band characteristics with each sequential filtration having a different pass band characteristic with all of the filtrations collectively passing a spectrum of light and an array of pixels being controlled by a system controller to pass the sequential filtration of light through the pixels to produce the image; and the actuator comprises an array of light valves disposed between the image source and the field of view with individual light valves being aligned with a single pixel and containing an array of apertures which each respectively correspond to a different position of a single light emitting point with each aperture having a frequency pass band characteristic matching only one of the comb filter characteristics of one of the sequential filtrations; and the system controller synchronizes selection of the filter characteristics and control of the pixels so that single filtration and control of the pixels occurs with each field of view of the image. The filter may be a rotating filter wheel having a plurality of sectors with each sector having a different comb filter pass band characteristic.

The invention may further include a look-up table storing data of at least one transmission characteristic of individual fibers which are optically coupled to a pixel of the image source and a single light emitting point of the image display. The image source is responsive to the stored data to control a light intensity of light which is outputted by the image source to each fiber optically coupled to a pixel to provide at least a uniform light transmission characteristic for the fibers optically coupled to the light emitting points. The at least one stored characteristic includes a multiplicative factor which is used to control the light intensity of the pixels to at least normalize the transmissivity of the fiber bundle.

The image source may have diverse forms. For example, without limitation, the image source may be one or more CRTs or a flat panel display such as, a backlighted liquid crystal display, an electroluminescent panel or an array of LEDs. When the image source is flat panel of the solid state type, such as produced by a liquid crystal display or an array light of emitting diodes, the image source and the image display are assembled as a unit and are not movable relative to each except that the actuator produces apparent or real relative motion of the light emitting points with respect to the FOV.

A method of optical display of an image in accordance with the invention includes generating an image including a plurality of fields which are sequentially displayed to form an image with a two-dimensional array of pixels forming each field having a spatially modulated light intensity; optically coupling the fields of the image to a two-dimensional array of a fixed number of at least two light emitting points spaced apart by a fixed distance along each dimension of the two-dimensional array; and moving the light emitting points in unison along two axes in a repeated pattern relative to a field of view to produce a displayed image viewed from the field of view with movement of each light emitting point along two axes during the repeated pattern delineating an area which is a fraction of the area of the displayed image produced by the display of the image viewed from the field of view with the light emitting points moving through the successive positions within the repeated pattern synchronized with the successive display of individual fields. The motion of the light emitting points in each of the two dimensions defining the area of the repeated pattern is through a plurality of the successive positions in displaying the fields of the image. The area delineated by the repeated pattern has a length of AX and a width of BX with a cross-sectional area of $ABX^2$ with A being an integer equal to or greater than 2, B being an integer equal to or greater than 2 and X being a dimension (diameter) of the light emitting points with a position of each light emitting point during movement of the array of points through the repeated pattern by the actuator moving a distance equal to AX along the length and BX along the width in synchronism with successive fields. A fiber optic bundle having a plurality of individual fibers transmits light for each of the pixels to the light emitting points with an individual optical fiber of the bundle which is optically coupled to a pixel transmitting light between a pixel and a light emitting point. An end of the fiber optic bundle is moved through the repeated pattern with the individual fibers of the end being spaced apart by a fixed distance and being optically coupled to the light emitting points. Light emitted from each of the fibers of the optical bundle may be refracted, deflected or reflected to move the light emitting points through the repeated pattern to form the displayed image of the array of light emitting points viewed from the field of view.

The fiber optic bundle transmits light from an image source to a helmet mounted head-up display which is movable relative to an image source and which provides images to be visually observed by a person wearing the helmet. An input optical image is transmitted to the helmet through the fiber optic bundle to the image source; the transmitted input image is analyzed and an image produced in response to the analyzed input image is transmitted through the fiber optic bundle to the helmet. The input optical image is optically coupled to a field of view of the helmet and the transmitted image to the helmet is an enhancement of an object in a field of view of the helmet. The input image includes an infrared image, a moving image or an image to be recognized from the FOV of the helmet.

The invention further includes transmitting light from the fiber optic bundle through an array of apertures which are spaced in a mask attached to an end of the fiber optic bundle with the individual apertures providing the individual light emitting points as viewed from the field of view and providing spacing between the light emitting points and moving the mask through the repeated pattern. A diameter of the apertures is smaller than a diameter of the end of each fiber which is attached to the mask and light transmitted through each aperture to the field of view is restricted to provide a light emitting point. The moving of the light emitting points in unison in the repeated pattern is along orthogonal axes with the movement being produced by at least one actuator.

The fields are comprised of a plurality of spatially non-overlapping parts provided from at least one image producing device or of spatially overlapping parts provided from different image producing sources. The spatially overlapping parts may be comprised of different colored images produced from different image producing sources which are combined to produce a color displayed image.

Further in accordance with the invention, a position of the array of light emitting points is sensed and movement of the array of light emitting points through the repeated patterns is controlled in response to the sensed position.

A light intensity of the pixels is controlled in response to a look-up of stored data of at least a transmission characteristic of individual fibers which are optically coupled to a pixel and to a light emitting point to provide at least a uniform transmission characteristic for the optical fibers coupled between the pixels and the light emitting points. The stored characteristic is at least a multiplicative factor which is used to control the light intensity of the pixels to at least normalize the transmissivity of the fibers.

The light emitting points may be produced by passing light from each pixel through an associated aperture in a mask having spaced apertures optically coupled to the field of view so that light emitted from one pixel passes through one aperture to provide spacing between the light emitting points as viewed from the field of view which is defined by a space between the apertures and the mask is moved through the repeated pattern to display the image as viewed from the field of view. A maximum dimension of the apertures is smaller than a maximum dimension of a pixel optically aligned with the aperture. Movement of the light emitting points is produced by relative motion between the light emitting points and the FOV.

BEST MODE FOR CARRYING OUT THE INVENTION

The embodiments of the present invention and the method of operation of an optical display system described below in conjunction with the drawings each provide an increased image bandwidth product of the displayed image viewed from a field of view (FOV) of the display without increasing the image source resolution. Increased image display resolution is produced without increased image source resolution by moving an array of light emitting points with a fixed spacing in a repeated pattern relative to the FOV of the displayed image with motion of each of the light emitting points along two axes in the repeated pattern delineating an area which is a fraction of an area of the display image produced by the displayed image. The repeated pattern produced by the image display has successive positions through which each light emitting point is moved which are synchronized with the successive display of individual fields by the image source. A one to one correlation exists between each field and each position within the repeated pattern. A new field is transmitted by the image source during the time interval between motion or apparent motion of the array of light emitting points between each successive position of the repeated pattern.

Figure 1:
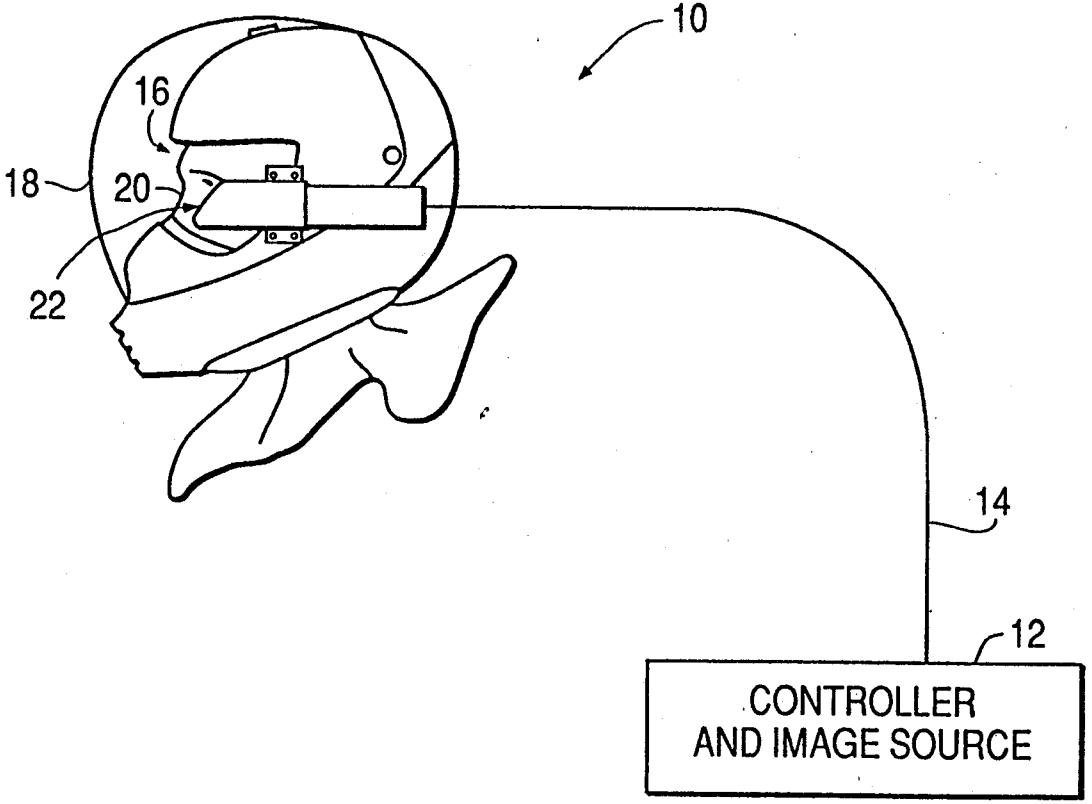
FIG. 1 is a diagram of a prior art helmet mounted head-up display.

The motion or apparent motion of the array of light emitting points along two axes is produced by an actuator controlled by a system controller. The actuator may cause actual physical motion of the array of light emitting points with respect to the FOV of the image display or apparent motion of the array of light emitting points caused by selective switching of a light transmission characteristic of an array of switchable optical cells which are fixed in position with sequential switching of the individual optical cells causing apparent motion of the array of light emitting points as viewed from the FOV of the image display. Each embodiment of the invention described below relies upon the aforementioned physical motion of the array of light emitting points or the apparent motion of the light emitting points produced by an actuator under the control of a system controller. A preferred application of the present invention is in a heads-up helmet mounted display system of the type described above in conjunction with FIG. 1. Like reference numerals identify like parts throughout the drawings.

Figure 2:
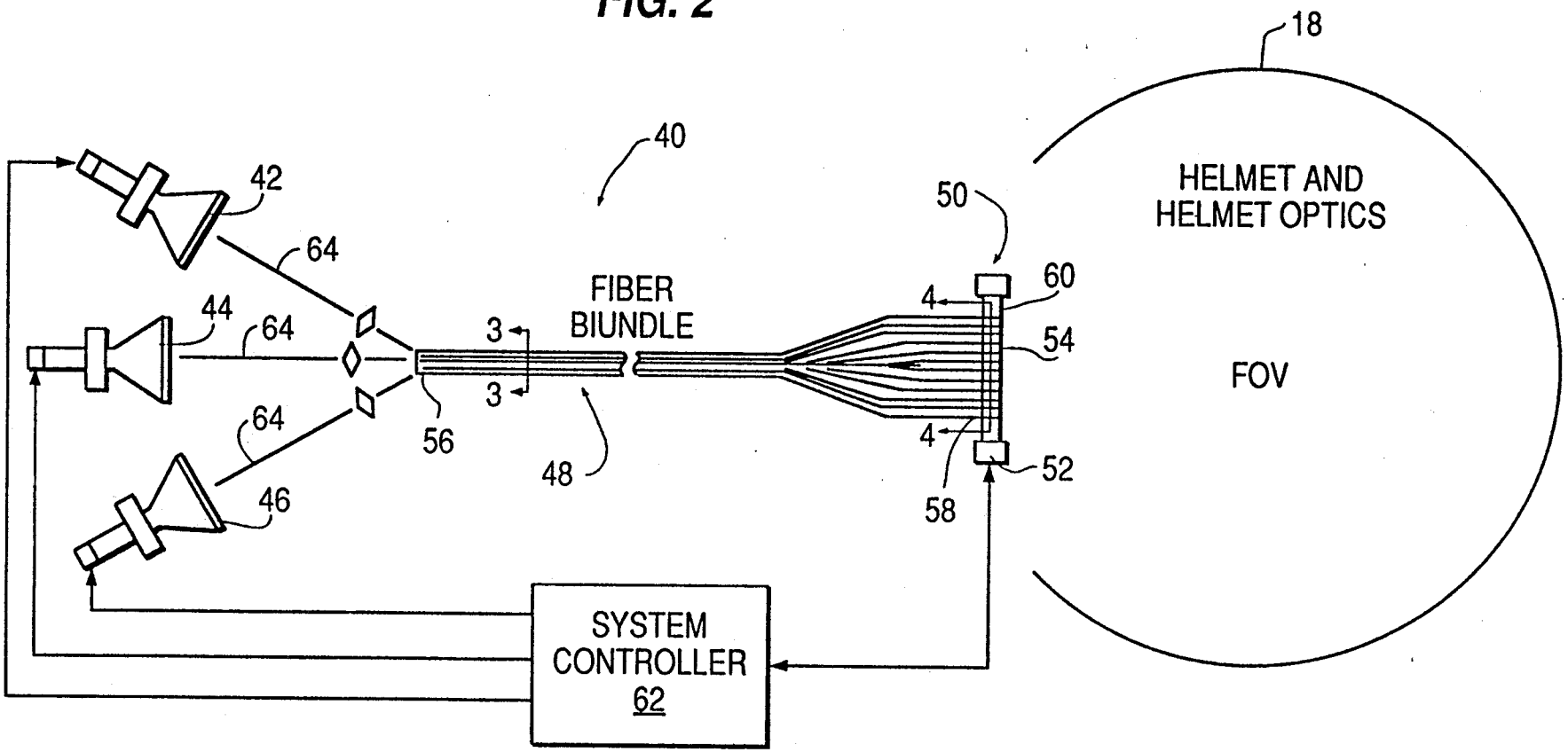
FIG. 2 is a diagram of a first embodiment of the present invention.
Figure 5:
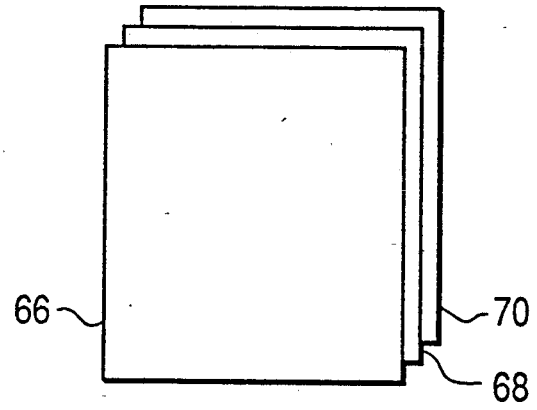
FIG. 5 illustrates a plan view of three images which are superimposed onto the fiber optic bundle of FIG. 2 to produce an overlapped image as the image source.
Figure 6:
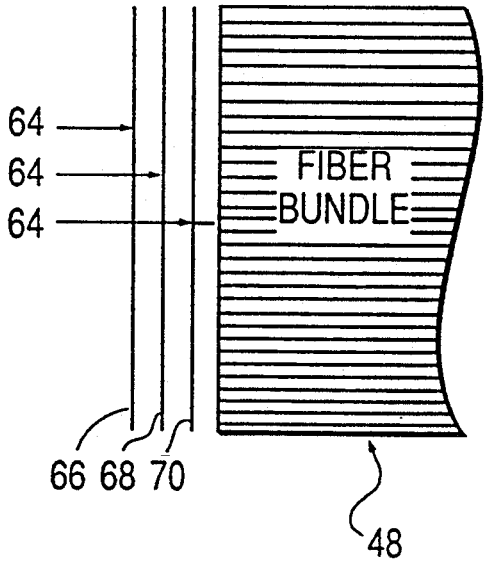
FIG. 6 illustrates a side elevational view of FIG. 5.
Figure 7:
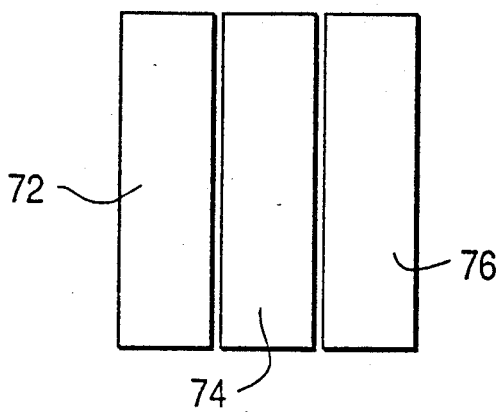
FIG. 7 illustrates three images which are not spatially overlapping which are incident upon the fiber optic bundle of FIG. 2.
Figure 8:
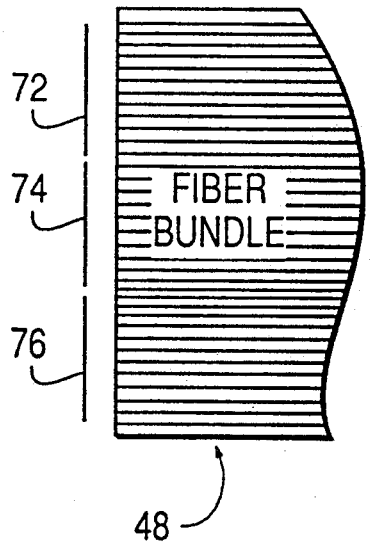
FIG. 8 illustrates a side elevational view of FIG. 7.

FIG. 2 illustrates a first embodiment 40 of the present invention utilized in a helmet mounted heads-up display of the type described above with respect to the prior art of FIG. 1. At least one image source which may include three image sources 42–46 generates an image which includes a plurality of fields sequentially displayed by the image source to form the source image with a two-dimensional array of pixels forming each field. Each field has a spatially modulated light intensity. The individual fields produced by each image source 42–46 may be spatially overlapping as illustrated in FIGS. 5 and 6 discussed below or spatially separated as illustrated in FIGS. 7 and 8 discussed below or may have other formats. The image sources 42–46 are preferably CRTs. However, it should be understood that the present invention is not limited to any particular image source for ultimately providing the two-dimensional array of pixels which form each field. Each field is comprised of a nxm array of pixels which are sequentially scanned by the cathode ray tubes 42–46. The number n is a number of pixels of a field extending in a first dimension and the number m is the number of pixels extending in a second dimension of a field. The dimensions are orthogonal to each other. In a typical array, a relatively low bandwidth source image is produced by fields with dimensions such as, but not limited to 256×256 as described below in the Examples. The pixels provided by the sources 42–46 are imaged upon a fiber optic bundle 48 normally having a one-for-one correlation of the number of pixels in each field produced by the image source with the number of fibers within the bundle as described below.

The image display 50, which is preferably mounted in a helmet 18, or helmet like structure, including helmet optics, such as in the prior art described above in conjunction with FIG. 1, includes a two-dimensional array of a fixed number of light emitting points with at least two light emitting points being disposed along each dimension of the two-dimensional array. Each light emitting point of the display 50 is spaced apart from adjacent light emitting points by a fixed distance of the display 50. The image display 50 includes an actuator 52 which produces relative or actual motion between the FOV and the array of light emitting points along two orthogonal axes as described below. Each light emitting point of the display 50 moves in a repeated pattern relative to the FOV of the displayed image in displaying the sequential fields of the source image or described below in FIGS. 11–13. Motion of each of the light emitting points along two orthogonal axes during the repeated pattern delineates an area which is a fraction of the area of the array of light emitting points on surface 54 of the display 50 where the image produced by the image display is viewed from the FOV. The FOB 48 has an input 56 having a cross section as described below in FIG. 3 and an output 58 which outputs the successive spatially modulated fields produced by the image sources 42–46 on a mask having an array of spaced apertures. The individual apertures are optically coupled to an individual fiber of the FOB 48 so that light emitted from one optical fiber passes through the aperture to provide a fixed and constant spacing between the light emitting points as viewed from the FOV which is defined by a spacing between the apertures. The mask 60 of the display 50 is moved by the actuator 52 through the positions of the repeated pattern as described below in FIGS. 11–13 to display the image produced by the image display 50 from the FOV. It should be understood that the motion produced by the actuator 52 of the light emitting points is synchronized with the display of sequential fields of the image sources 42–46 such that a new field is transmitted through the FOB 48 for each subsequent position of the repeated pattern as described below in FIGS. 11–13. Moreover, the motion of the array of light emitting points through the positions of the repeated pattern as described below in conjunction with FIGS. 11–13 produced by the actuator may be continuous with either a constant or non-constant velocity or in steps. The mask is described below in conjunction with FIGS. 14 and 15. It should be noted that the actuator 52 has a first pair of elements, as illustrated, which produce reflection along one axis and a second pair of elements (not illustrated) which are orthogonal with respect to the first pair of elements which are illustrated to produce deflection of the mask 60 along a second axis orthogonal to the first axis.

The system controller 62 synchronizes the operation of the image sources 42–46 and the image display 50 so that the motion of the light emitting points through successive positions of the repeated pattern is synchronized with the successive display of individual fields by the image source as described below. The system controller 62 provides control of the position of the individual beams produced by the individual CRTs which implement the image sources 42–46. The control of the individual beams of the CRTs of the image sources 42–46 desirably includes a mechanism for controlling the position of the beam so that individual pixels within the fields of the image produced by the image sources 42–46 are precisely registered at desired locations at the time of scanning. The control of the beam position may be in accordance with U.S. Pat. No. 4,924,254, which is assigned to the Assignee of the present invention which is incorporated by reference herein in its entirety. Furthermore, the system controller 62 is preferably responsive to a signal from the actuator 50 which identifies the actual position of the mask 60 producing the array of light emitting points. Actual position control of the array of light emitting points of the display enhances synchronism with the image source 42–46 and results in a display image which is free from artifacts which could be produced from a position error of the mask 60.

Figure 3:
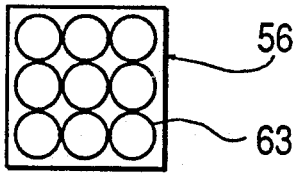
FIG. 3 is a sectional view of FIG. 2 taken along section lines 3—3.

FIG. 3 illustrates a cross section of the image input 56 of the FOB 46. It should be understood that the number of fibers 62 is normally equal to the number of pixels which are contained in an individual field produced by the image sources 42–46. The 3×3 array is only symbolic of the mask layer array of fibers of the FOB 48. Without limitation, a typical fiber optic bundle, which may be used in practicing the invention, may be an array of 256×256 fibers. A FOB of these dimensions does not suffer from the weight, size or manufacturing limitations of larger prior art FOBs such as 1,024×1,024 which have been fabricated for helmet mounted displays. The image sources 42–46 are controlled such that the output light beams 64 are precisely registered on the individual fibers 63 of the FOB 48. The addressing of individual fibers 63 of the FOB 48 may, without limitation, produce either spatially overlapped images as described below in conjunction with FIGS. 5 and 6 or non-spatially overlapped images as described below in FIGS. 7 and 8. Preferably, the actuator 52 provides position feedback to the system controller as described below in conjunction with FIG. 17. The feedback of the position of the actuator 52 is used by the system controller 62 to synchronize the relative position between the input beams 64 and the movement of the mask 60 to cause relative movement between the FOV and the array of light emitting points as described below in conjunction with FIGS. 11–13.

Figure 4:
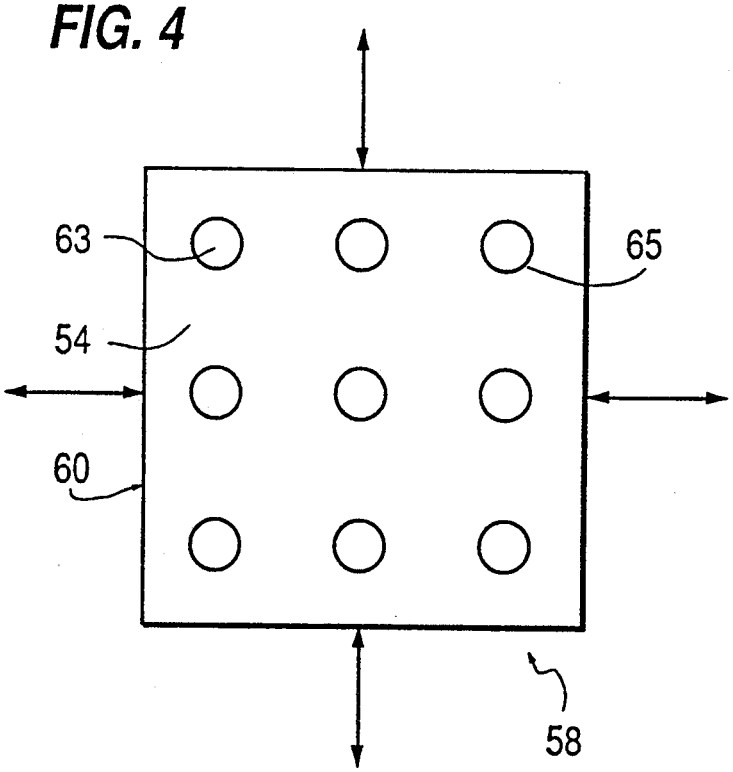
FIG. 4 is a sectional view of FIG. 2 taken along section lines 4—4.

FIG. 4 illustrates a cross section of the output 58 of the FOB 48 as joined to the mask 60. The individual fibers 63 are separated by a fixed distance which is established by apertures 66 within the mask 60. The individual fibers 63 may be contained within holes formed within the mask 60 which is coated with an opaque optical material with the apertures 65 located in front of each fiber 63. The apertures 65 permit the precise location of the spacing between the individual light emitting points as viewed from the FOV which appear on the front surface 54 of the mask 60. Furthermore, the individual apertures may be coated with a material which has a selective transmission characteristic to optical energy either in the visible or non-visible regions. It should be understood that the display 50 is mounted within the helmet and helmet optics 18 with the mounting not being illustrated in FIG. 2 for purposes of clarity. The bidirectional arrows represent the motion produced by the actuator 52 of the mask 60 which produces the motion of the light emitting points described below in conjunction with FIGS. 11–13.

FIGS. 5 and 6 respectively illustrate symbolic front and side views of individual fields of images 66–70 produced by the image sources 42–46 which each include an nxm array of pixels with the images being spatially overlapped. Each field is updated in synchronism with movement between subsequent positions described below in conjunction with FIGS. 11–13. The separate spatially overlapping images 66–70 are respectively produced by the image sources 42–46 with the illustration being for purposes of visualizing the spatial overlap of the images. The system controller 62 synchronizes the production of the individual images 66–70 with the movement of the mask 60 by the actuator 52 to produce a display viewed from the plane 54 of the mask 60 from the FOV.

FIGS. 7 and 8 illustrate symbolically non-spatially overlapped images 72–76 which are respectively produced by the image sources 42–46. It should be understood that the plane of view of FIG. 8 has been rotated 90 degrees with respect to the plane of view of FIG. 7.

While the present invention may be practiced with a single image source, the use of multiple image sources 42–46 to produce either spatially overlapped or non-spatially overlapped fields or fields of other formats which are coupled to the fiber optic bundle 48 has the benefit of reducing the bandwidth of the optical source image which must be produced when compared to producing a single source image to produce all of the fields which are coupled to the fiber optic bundle 48. Each image source 42–46 may simultaneously output its respective fields of information to the input 56 of the FOB 48 to reduce the overall bandwidth of each of the fields of the image which are coupled to the fiber optic bundle when compared to an image produced by a single image source.

Figure 9:
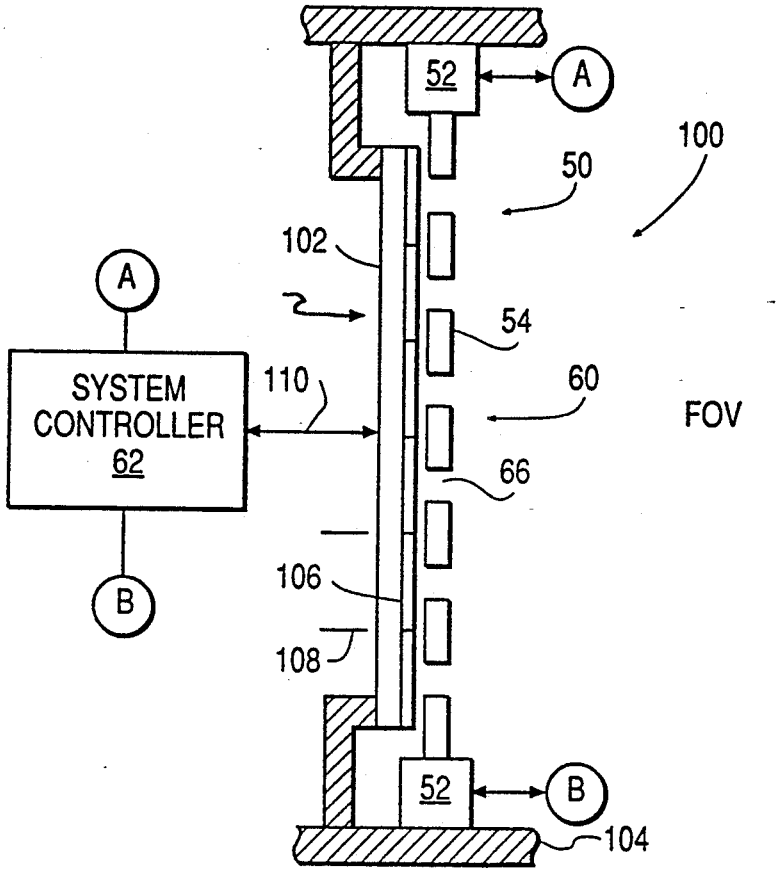
FIG. 9 illustrates a side elevational view of a second embodiment of the present invention.
Figure 10:
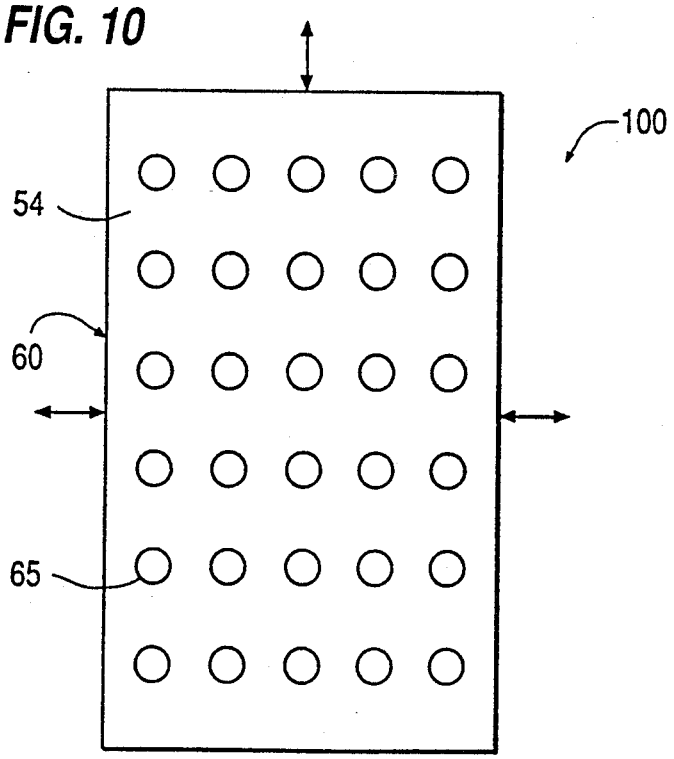
FIG. 10 illustrates a front view of the second embodiment of the present invention viewed from the field of view of the displayed image.

FIGS. 9 and 10 illustrate a second embodiment 100 of the present invention in which a wide area display source 102 replaces the individual image sources 42–46 of FIG. 2 and the fiber optic bundle 48 is eliminated as a consequence of output light from the image source 102 being directly optically coupled to the mask 60 of the image. It should be noted that the image source 102 and the image display 50 are attached together and are not movable relative to each other with the exception of the actuator 52 which produces relative motion of mask 60. The wide image source 102 may be without limitation a wide area display source, such as an electroluminescent panel, a plasma panel or a back-lighted liquid crystal display which, if implemented in a helmet 18 of a helmet mounted heads-up display, is rigidly attached to the helmet by a helmet mount 104. The system controller 62 operates in a manner analogous to the first embodiment described above in conjunction with FIG. 2. The system controller 62 controls the activation of individual cells 106 of the image source which have a dimension delineated by cell boundaries 108. The control line 110 is only symbolic of the electrical connections between the system controller 62 and the individual cells 106 of the image source 102 which control the cells to produce the sequential fields of the source image. Each cell 106 defines an individual pixel of the image source 102 with the outputting of light by the individual cells 106 being used to produce sequential fields each containing an array of pixels nxm, as described above. FIG. 10 illustrates an end view of the embodiment 100 of FIG. 9 which illustrates the mask 60. The mask 60 is identical to that illustrated in FIG. 4 with the exception that the FOB 48 of FIG. 2 is not utilized. The bidirectional arrows represent the movement produced by the actuator 52 to cause movement of the array of light emitting points as viewed from the FOV which produce the image at the image display 50 as viewed from the FOV.

Figure 11:
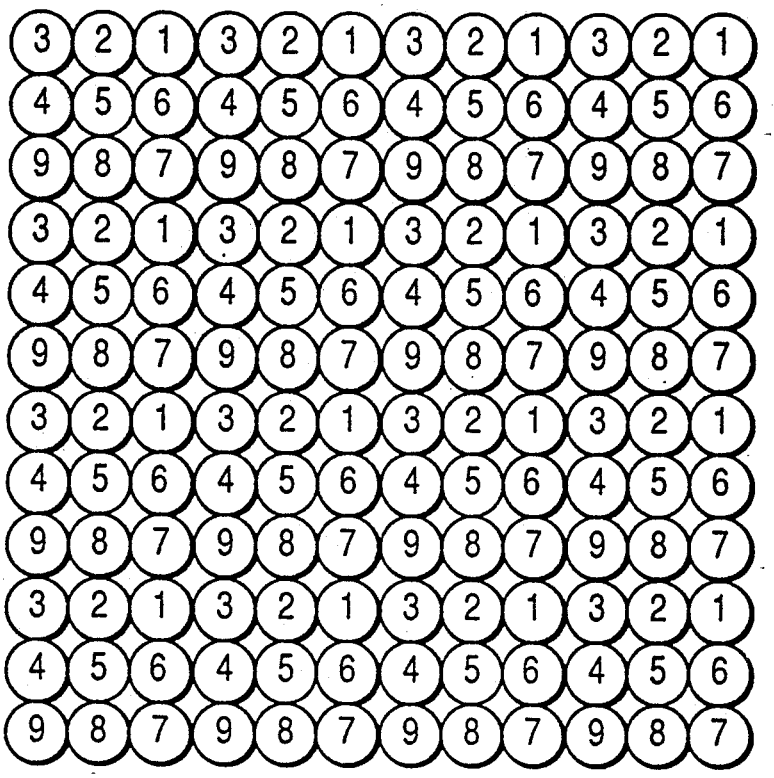
FIG. 11 illustrates the sequence of positions of a matrix of light emitting points viewed from the field of view of the displayed image produced by an actuator in accordance with the embodiments of the present invention.
Figure 12:
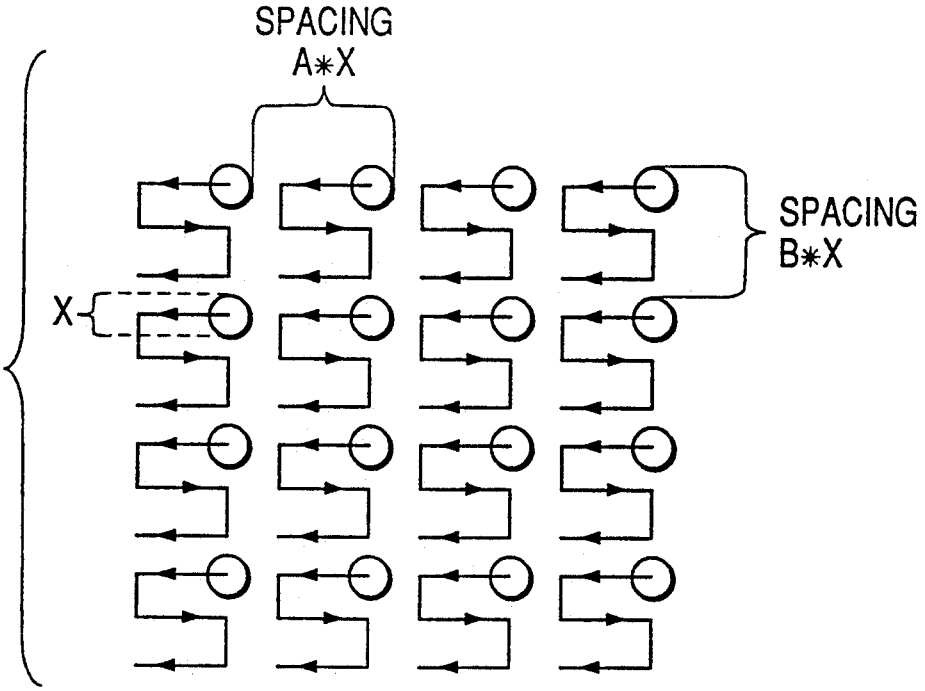
FIG. 12 illustrates the movement of a 4×4 array of light emitting points through a series of nine positions as illustrated in FIG. 11 under the control of an actuator in accordance with the present invention.
Figure 13:
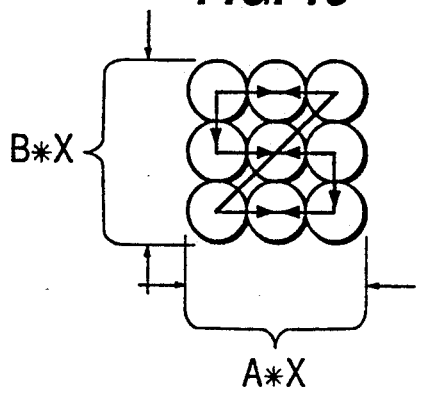
FIG. 13 illustrates motion of an individual light emitting point of FIGS. 11 and 12 under the control of an actuator in accordance with the present invention.

FIGS. 11–13 illustrate the relative movement between a small subsection of the array of individual light emitting points as viewed from the FOV of the image display of each of the embodiments of the present invention as described above and below. As illustrated, the array of FIGS. 11 and 12 is 4×4 as described below. Each of the embodiments of the invention utilizes an actuator to move each light emitting point in a repeated pattern relative to the FOV of the image display with motion of each of the light emitting points along two axes in the repeated pattern delineating an area which is a fraction of an area as viewed from the plane 54 of the light emitting points. The actuator causes actual or perceived motion of the light emitting points through successive positions of the repeated pattern in synchronism with the successive display of individual fields by the image source. As stated above, the motion may be continuous with a constant or varying velocity or the motion may be in steps. Each successive position of a single light emitting point is identified by a circle containing a number with a repeating sequence of nine positions for each of the 16 light emitting points being illustrated. It should be understood that the light intensity and or color content of the display image viewed from the FOV of the display is modulated by the image source. The intensity modulation and or color modulation at the image source may be controlled with digital or analog control techniques. Each light emitting point of the array of light emitting points, which contains at least two light emitting points along each orthogonal axis of the array, may be visualized as being moved through successive numbered positions which are identified by the circles containing the numbers 1-9. As illustrated, each light emitting point moves two steps to the left, one step down, two steps to the right, one step down, two steps to the left and either back to the position containing the number 1 in a circle by a retrace diagonally across the cross-sectional area swept out by the light emitting point or precisely in the opposite sequence through the positions identified by the circles containing the numbers 9-1. Each numbered position contained within a circle corresponds to the display of a field produced by the at least one image source.

The successive positions as illustrated are produced by an actuator, such as actuator 52 of FIGS. 2 and 9, which may take differing forms as described above and as described below. The actuator may cause actual physical movement of the array of light emitting points or apparent physical movement by selective switching of light transmitted from an image source through light valves which contain a number of points corresponding to the number of positions of each light emitting point moving through the repeated pattern. In a typical embodiment of the present invention, the number of light emitting points may be a large array such as, 256×256 pixels, with each pixel moved through a plurality of positions which are typically in a square array having two or more positions along both the X and the Y axes.

FIG. 12 illustrates with arrows the path of motion illustrated sequentially by ascending numbers contained within the circles of FIG. 11. The circle, as illustrated in each of the points within the 4×4 matrix of FIG. 12, corresponds to the position with the number 1 contained within a circle illustrated in FIG. 11 described above. The area delineated by the repeated pattern has a length of AX and a width of BX with a cross-sectional area of $ABX^2$ with A being an integer equal to or greater than 2, B being an integer equal to or greater than 2 and X being a diameter of individual light emitting point. The area $ABX^2$ is a fraction of the area of the display image viewed from the FOV. Each position contained in a numbered circle in FIG. 11 and each corresponding successive position as illustrated by the path of motion delineated by arrowheads in FIG. 12 is the repeated pattern produced by the actuator moving incrementally a distance equal to X along the length or along the width of the array of light emitting points in synchronism with successive fields displayed by the image source.

FIG. 13 illustrates the motion of a single light emitting point through a succession of positions which correspond to the nine positions of FIG. 11. It should be noted that the numbers contained within the individual positions, as illustrated in FIG. 11, have been omitted from FIG. 13 for purposes of clarity. The direction of movement of the light emitting points may be either in moving sequentially through the numbered positions 1-9 of FIG. 11 and back through the numbered positions 9-1 as indicated by the bidirectional arrows or, alternatively, with the diagonal line segment extending from what corresponds to position 9 in FIG. 11 back up to position 1 of FIG. 11. Either methodology of movement of the individual light emitting points under the control of an actuator may be utilized by the present invention to produce a high resolution image with a high resolution space bandwidth produce viewed from the FOV.

Figure 14:
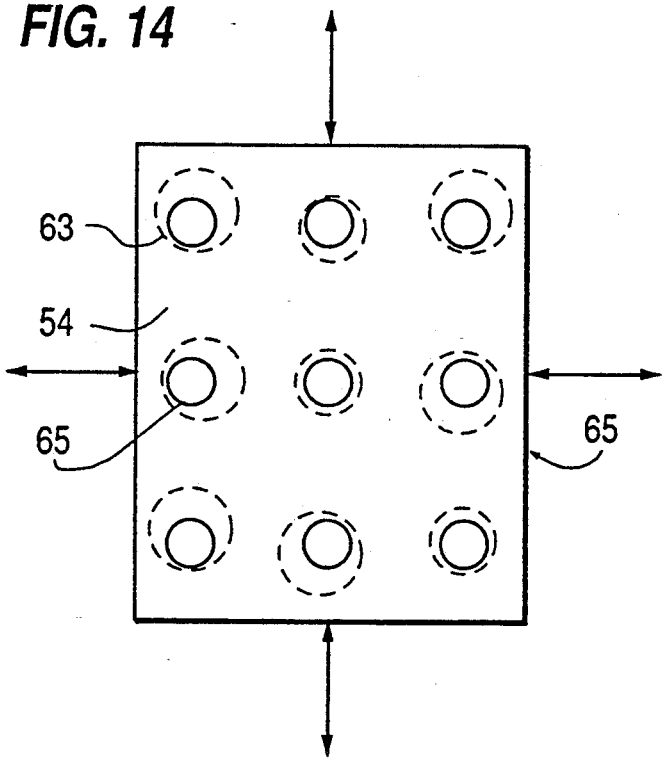
FIG. 14 illustrates an end view of a mask utilized for providing a uniform spacing between individual light emitting points produced by the fiber optic bundle of the embodiment of FIG. 2.
Figure 15:
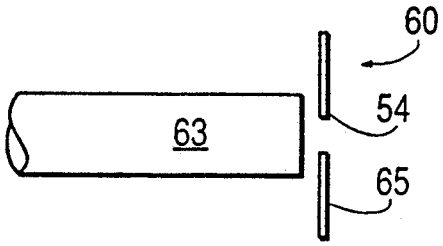
FIG. 15 illustrates a side elevational view of a single fiber aligned with the mask of FIG. 14.

FIGS. 14 and 15 illustrate the use of the mask 60 to produce a uniform spacing between the light emitting points in the plane 54 as viewed from the FOV of the embodiments of FIGS. 2 and 9. Preferably, the individual fibers 63 are larger in diameter than the individual apertures 65 in the mask 60 such that the spacing of the light emitting points as viewed from the FOV is defined by the spacing between the apertures 65. The dimensions of the individual apertures 65 is identical and the spacing between apertures is identical along each axis which produces an array of light emitting points viewed from the FOV which is free from artifacts caused by the size or positional error of the individual light emitting points relative to each other. The bidirectional arrows indicate movement of the mask 60 produced by the actuator. Preferably, the spacing between individual light emitting points, which are defined by the aperture 65, is uniform along each axis, but may differ between the two orthogonal directions. It should be understood that the number of apertures, as illustrated in FIG. 14, has been greatly reduced with a typical array including such as 256×256 light emitting points. It should further be understood that the cross-sectional area of each light emitting point, while illustrated in FIG. 14, as being circular, may be rectangular or square in cross section.

Figure 16:
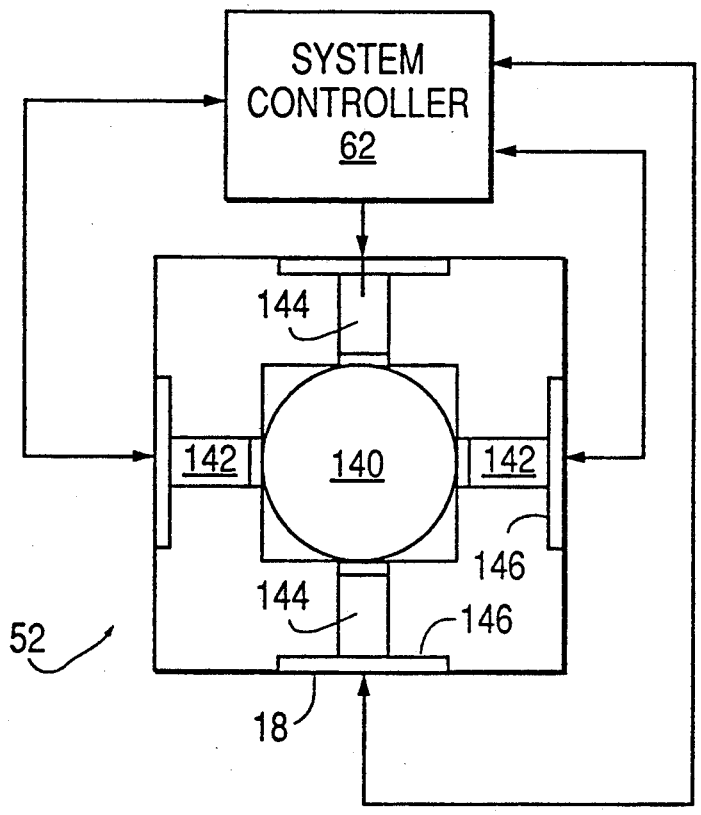
FIG. 16 illustrates a system controller and drive elements which form an actuator for positioning the array of light emitting points such as those produced by movement of a mask, a fiber optic array, a lens or a mirror to form a displayed image from a field of view.

FIG. 16 illustrates an actuator 52 for moving the array of light emitting points through the repeated pattern described above in conjunction with FIGS. 11-13. As illustrated, the moved element 140 may be a mask, such as the mask 60 described above, the display end of the optical fiber bundle as illustrated in FIG. 2 without attachment to a mask, a lens or a mirror. The actuator 52 contains a first pair of elements 142 which control movement along the X axis and a second pair of elements 144 which control movement along the Y axis under the control of the system controller 62. Positional feedback of the actuator to the system controller 62 is desired. The elements 142 and 144 of the actuator 52 may without limitation comprise piezoelectric elements, electromagnetic elements, such as voice coils, or any other mechanism for moving the array of light emitting points through the repeated pattern as described above in conjunction with FIGS. 11-13 in an X axis Y axis pattern. Each of the pairs of elements 142 and 144 may be coupled to a mounting point 146 within the helmet of a helmet mounted head-up display as described above in conjunction with FIG. 2. The system controller 62 controls the positioning of the pairs of elements 142 and 144 to move the individual light emitting points through the sequence of positions as illustrated in FIGS. 11-13 described above. The feedback of the position of each of the elements 142 and 144 of the actuator 52 to the system controller 62 provides the system controller with positional information for synchronizing the movement of the array of light emitting points with the display of successive fields by the image source. It should be noted that FIG. 16 has omitted the image source which may take on diverse forms as described above or below.

Figure 17:
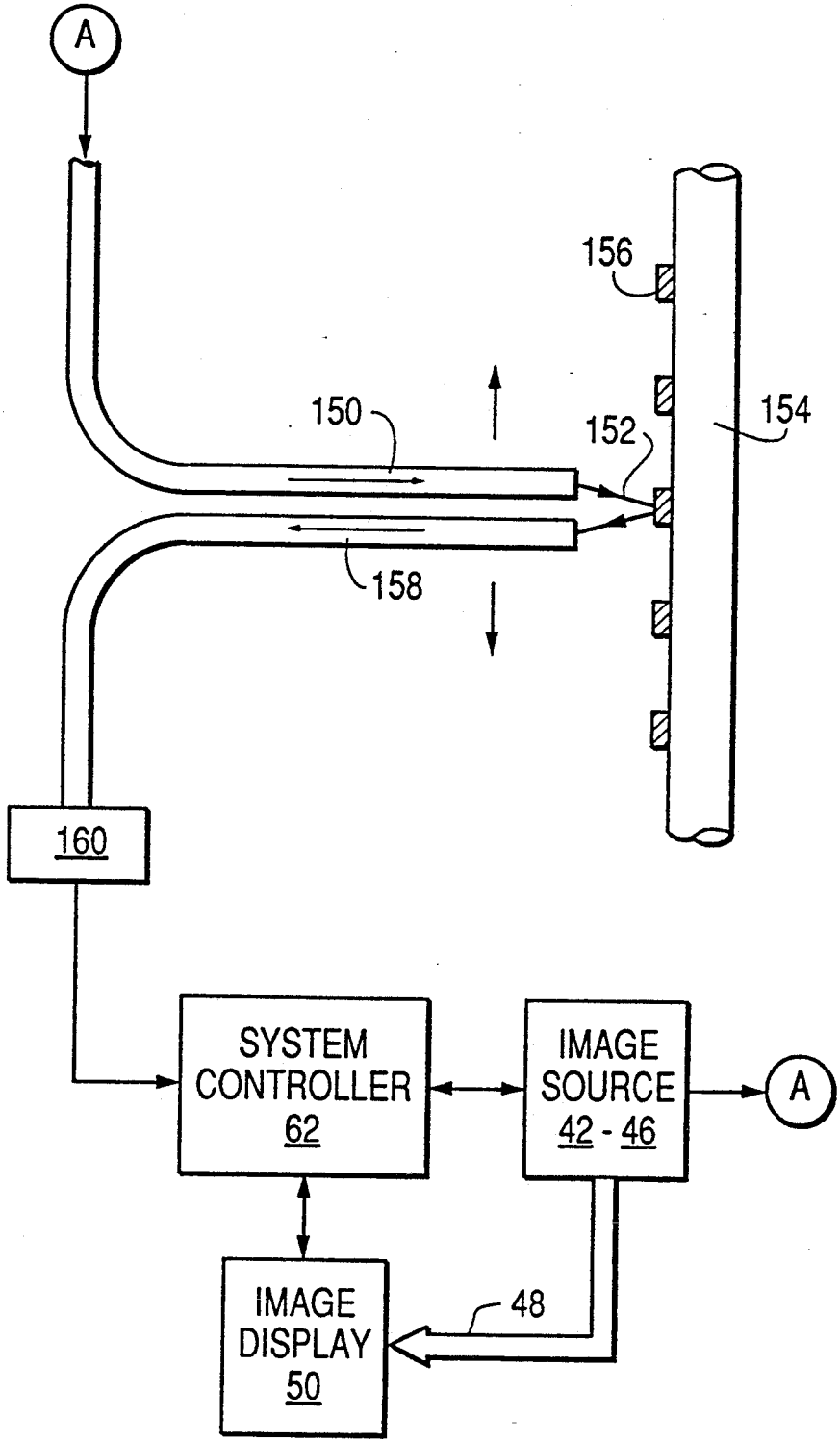
FIG. 17 illustrates a system for controlling positioning of the array of light emitting points to synchronize the motion of the image display with the image source of the present invention.
Figure 18:
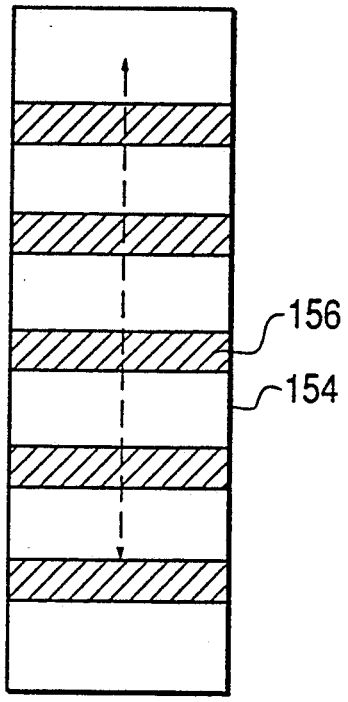
FIG. 18 illustrates an end view of the reflective regions of FIG. 17 which are used as reference positions for determining the position of the array of light emitting points with respect to the field of view of the image display.

FIGS. 17 and 18 illustrate a system for providing positional information to the system controller of the relative position between the array of light emitting points and a part of the image display which is not moved by the actuator. The image source may be in accordance with the image sources 42–46 of FIG. 2 and the image display may be in accordance with the image display 50 of FIG. 2. The actuator, which is not specifically illustrated, is understood to be contained within the image display 50. The system includes at least one input fiber 150 which is coupled to a light source which typically is produced by the image source 42–46 but may be a light which is not modulated in intensity. The at least one input fiber 150, which is understood to be part of the FOB, has an output 152 which is transmitted to a target area 154 which is attached to a part of the helmet 18 and which is not moved by the actuator. A plurality of reflective areas 156 receive light outputted from the output 152 of the at least one input fiber 150. Relative motion of the at least one input fiber 150, which is part of the FOB 48, causes the light outputted from the end 150 to successively fall on the reflective areas 156 when the fiber optic bundle 48 is moved between successive positions as described above with respect to FIGS. 11–13. Each reflective area 156 corresponds to a successive position along one of the axis of the orthogonal axes along which the FOB 48 is moved by the actuator. When light outputted from the at least one fiber 150 from the output 52 is reflected from one of the reflective areas 156 to at least one output fiber 158, photosensor 160 produces an output signal which is coupled to the system controller 62 to provide the system controller with an indication of the relative position of the fiber optic bundle as moved through the successive positions of the repeated pattern relative to the portion of the helmet which is not moved by the actuator. The system controller 62 processes the output signals produced by the photosensor 16 which are produced sequentially by movement of the end of the fiber optic bundle relative to the reflective areas 156. The system controller 62 in response to the output signals from the photosensor 160 commands the actuator within the image display 50 to control the position of the splayed end of the FOB to insure synchronism between the successive positions of the fiber optic bundle of FIGS. 11–13 and successive fields produced by the image source 42–46 as described above. Alternately, the timing of the display of successive fields produced by the image source 42–46 may be modified to achieve the desired synchronism between the displayed fields and the successive positions of the fiber optic bundle.

FIG. 18 illustrates a front view of the target area 154, including reflective areas 156. The dotted line bidirectional arrow indicates the direction of motion produced by the actuator which causes the output signal of the photosensor 160 to change state. It should be understood that motion in a directional orthogonal to the bidirectional arrow of FIGS. 17 and 18, which is produced by the actuator moving the array of light emitting points along an orthogonal axis, does not produce a change of state as a consequence of the longitudinal dimension of the reflective area spanning the full width or length along which the array of light emitting points is moved by the actuator.

Figure 19:
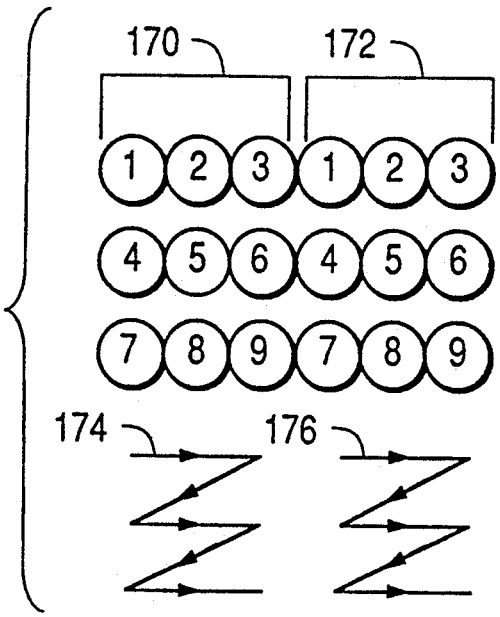
FIG. 19 illustrates successive positions of a pair of light emitting points in producing a display using normal scanning in accordance with the present invention.
Figure 20:
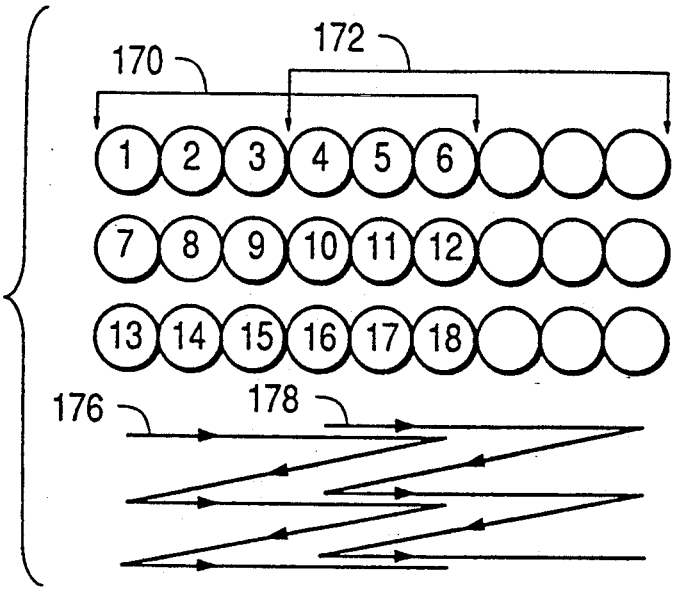
FIG. 20 illustrates the successive positions of a pair of light emitting points identical to FIG. 19 when overscanning is used to compensate for the effects of non-uniform transmission characteristics of a fiber in a fiber optic bundle.

FIGS. 19 and 20 respectively illustrate the normal repeated pattern through which a pair of light emitting points is moved by an actuator and an overscanning repeated pattern by which a pair of light emitting points is moved by an actuator to compensate for the effect of single broken fibers or fibers which otherwise do not produce an output within the array of light emitting points. It should be understood that overscanning is only used in conjunction with scanning individual light emitting points corresponding to defective fibers or defective optical coupling between an image source pixel and a light emitting point of the image display. The cause of not producing an output in the array of light emitting points may be caused by diverse causes such as broken fibers or misalignment of an individual fiber 63 with an aperture 65 of the mask 60. In FIG. 19, the repeated pattern of movement of the first light emitting point is identified by 170 and the repeated pattern of movement of the second light emitting point is identified by 172. The numbered positions 1–9 contained within the circles correspond to the successive positions of the individual fibers 170 and 172 moving through the repeated pattern having a scanning motion as identified by the zigzag scanning pattern 174 and 176 and as described above in FIGS. 11–13. It should be noted that FIG. 19 illustrates the normal pattern in which adjacent fibers 63 corresponding to the repeated patterns 170–176 of a pair of light emitting points of the FOB 48 have a transmission characteristic which does not produce an artifact which is visible from the FOV of the image display. FIG. 20 illustrates the use of overscanning in which the actuator doubles the length of motion and accordingly doubles the number of successive positions in a repeated pattern associated with a defective fiber along one of the axis of the two axes along which the actuator moves or causes perceived movement of the array of light emitting points. As illustrated in FIG. 20, the succession of numbers contained within the circles representing positions of the light emitting points, which correspond to the successive positions of the pair of light emitting points 170 and 172 of FIG. 19, assume six positions along an axis instead of three positions as illustrated in FIG. 19. The scan patterns 176 and 178 are respectively doubled along one axis in FIG. 20 as compared to the scan patterns 174 and 176 in FIG. 19. The redundant coverage provided by the doubling of the scanning with a doubling of the number of positions along one axis is used to remove the effects of non-transmissivity of individual fibers 63 within the FOB 48 by selectively activating an adjacent fiber during the second half of the overscan repeated pattern. This procedure requires that broken fibers be identified or known to the system controller 62 so that the adjacent fibers can be activated at the proper time with correct image data for the particular pixels which are being scanned. The benefit which is provided by the overlapped scanning of FIG. 20 is that the fiber bundle does not have to be perfect to properly functional to produce an image not containing artifacts as viewed from the FOV. The tradeoff requires that the scan length along one axis is doubled which increases the bandwidth required of the display source 42–46 to correct for defective transmission characteristics of the individual fibers by displaying an additional pixel. The overscanning procedure of FIG. 20 would be typically limited to a situation where no two bad fibers 63 are adjacent to each other in the FOB and is only used when defective fibers are present. Storage or control data is in accordance with the look-up table of FIG. 25.

Figure 21:
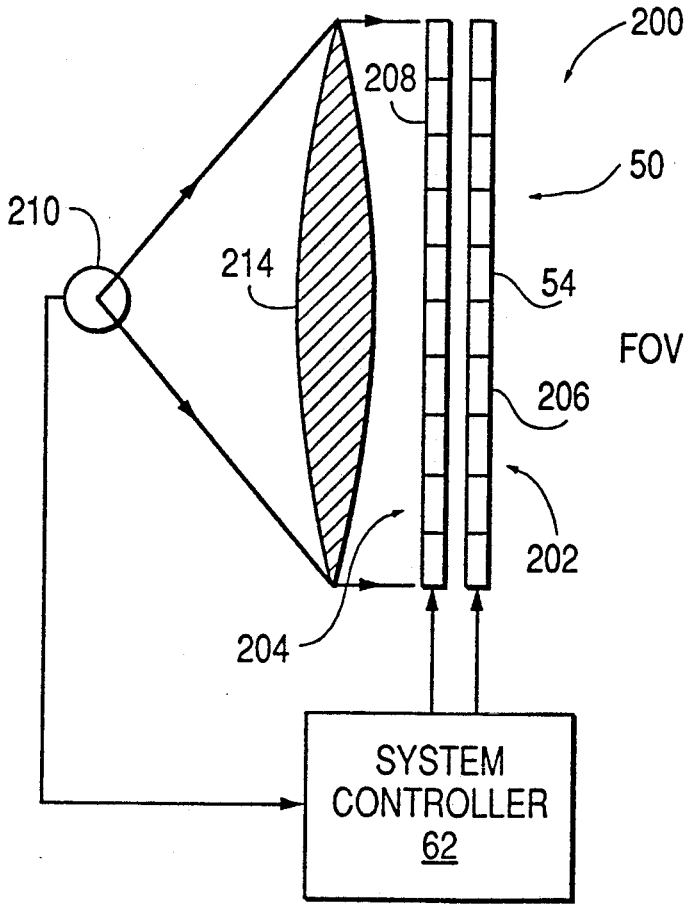
FIGS. 21 illustrates a third embodiment of the present invention in which an array of electronically selectable aperture elements are utilized to produce apparent relative motion between the field of view and array of light emitting points without physical movement caused by an actuator.
Figure 22:
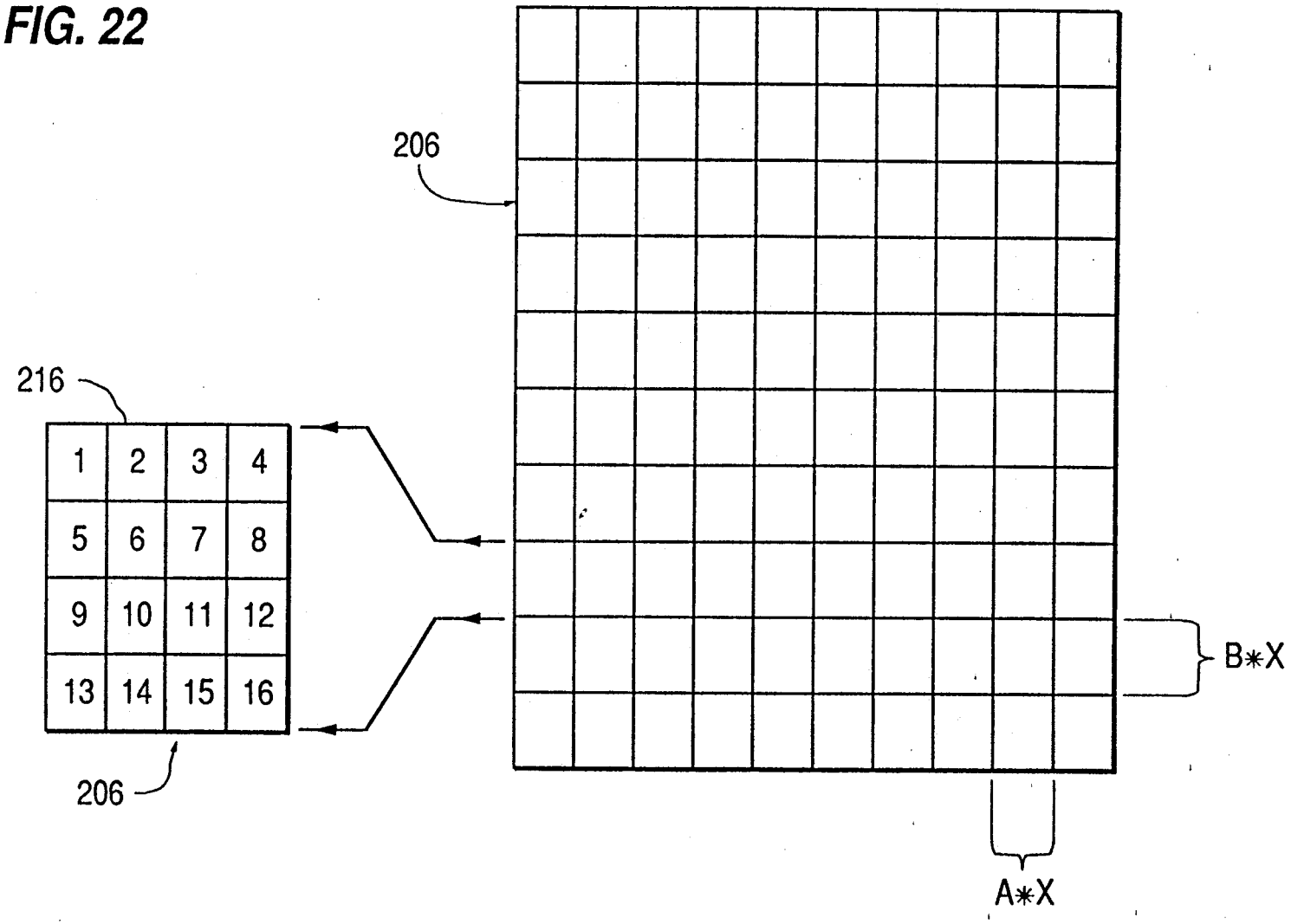
FIG. 22 illustrates a front view of the third embodiment of the present invention.

FIGS. 21–22 illustrate a third embodiment 200 of the present invention. In the third embodiment, the actuator 202 relies upon the successive selection of apertures within a light valve cell 206 to pass light from an image source 204. The image source 204 and the image display 50 are fixed relative to each other and not movable physically relative to each other with only the selecting of apertures 216 producing the light emitting points of the display image. This selection of aperture elements duplicates the effect of the physical movement of the mask 60 caused by the actuator 52 described above and below to the image display plane 54 where the array of light emitting points is visible from the FOV. The selectible apertures within each light valve cell 206 are selected electronically by controller 62. The number of cells 206 corresponds on a one for one basis with the number of pixels 208 of the image source 204. The number of pixels 208 is in an nxm array such as that described above in conjunction with the image sources 42–46. The image source may be a back-lighted LCD which is arranged as an array of pixels which are selectively controlled by system controller 62. The number of apertures within each light valve cell 206 corresponds to the number of positions within the repeated pattern and the number of fields produced by the image source 204. Light is directed from a light source 210 onto the LCD panel of the image source 204. The LCD array of individual pixels 208 functions as a light valve with each pixel being independently transmissive of light or blocking of light from the source 210. Viewed from the FOV, the individual pixels 208 are either light or dark depending upon whether they are in a transmitting or non-transmitting state. Each light valve cell 206 is optically aligned with a single pixel 208 and consists of a grouping of selectible apertures 216, as illustrated in FIG. 22, which may be independently opened or closed to transmit or block light. Each aperture 216 corresponds to a different position of a single light emitting point with each aperture being switchable by the system controller 62 to pass light from the aligned pixel. The size of a light valve cell 206 corresponds to the size of the pixels 208 of the image source 204. In operation at any particular time, only one aperture 216 in each cell 206 is opened to transmit light with all cells displaying an identical pattern of open or closed apertures such that each cell has the same aperture 216 (e.g. 1) opened at the same time. When an aperture is open, the aperture transmits light and when an aperture is closed, it blocks light. The pattern of individual apertures within a light valve 206 is illustrated in FIG. 22 with the individual cells being identified by a square containing a series of smaller square boxes each containing a number which corresponds to the selectible apertures within each light valve cell. The total number of apertures 216 within all of the cells 206 corresponds to the total resolution of the number of pixels which may be viewed from the FOV. The number of individual selectible apertures 216 corresponds to the number of fields produced by the image source 204. The sequential opening of the individual elements of cells 216 in accordance with the numbered pattern in FIG. 22 under the control of the system controller 62 produces a highly interlaced display which is equivalent to that produced by the physical motion produced by the actuator 52 in moving the array of light emitting points as described above and below. The system controller 62 synchronizes the display of the fields of the image and the switching of the apertures 216 to produce movement of the light emitting through the repeated pattern with each successive position of a light emitting point corresponding to a different field of view of the image source.

Figure 23A:
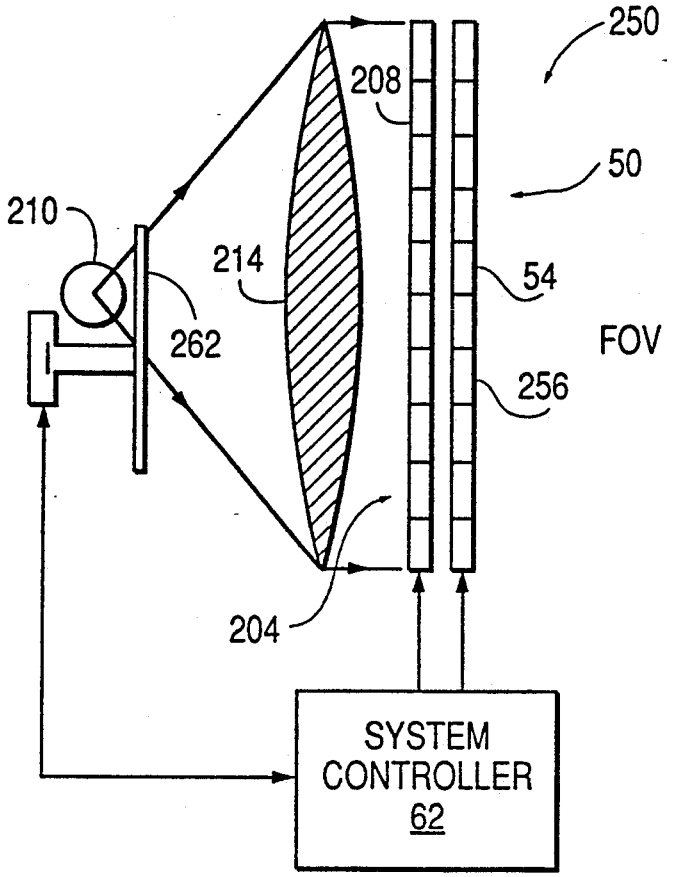
FIGS. 23A and 23B illustrate a fourth embodiment of the present invention in which an array of visual filter elements having a selected frequency transmission characteristic is utilized to produce apparent relative motion between the field of view and array of light emitting points without physical movement caused by an actuator.
Figure 23B:
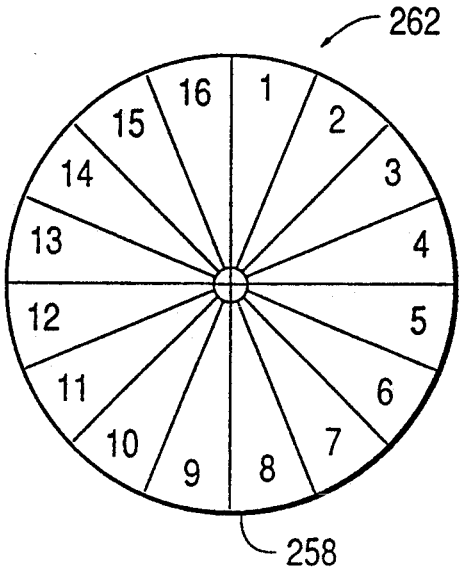
Figure 24:
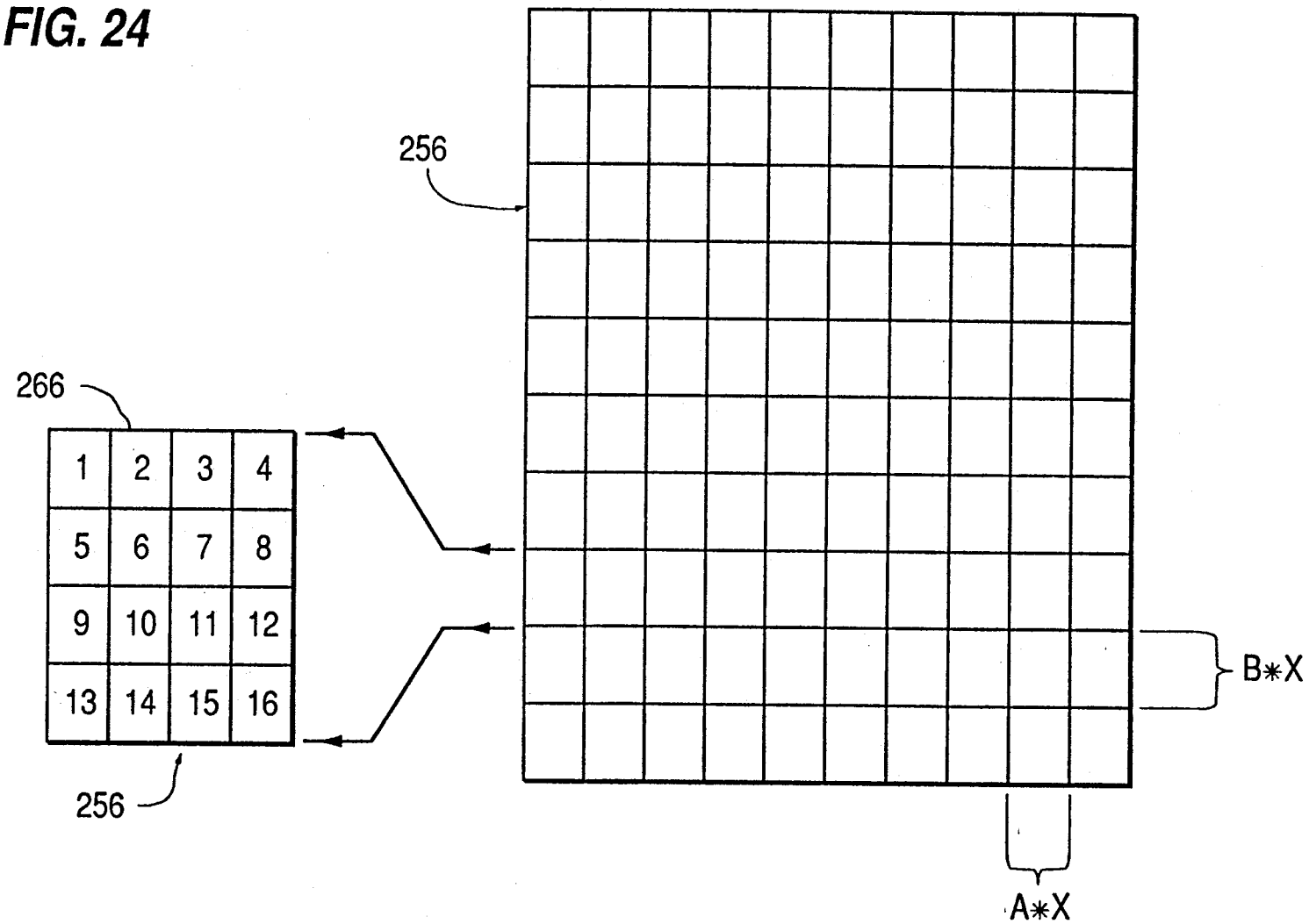
FIG. 24 illustrates a front view of the fourth embodiment of the present invention.
Figure 25:
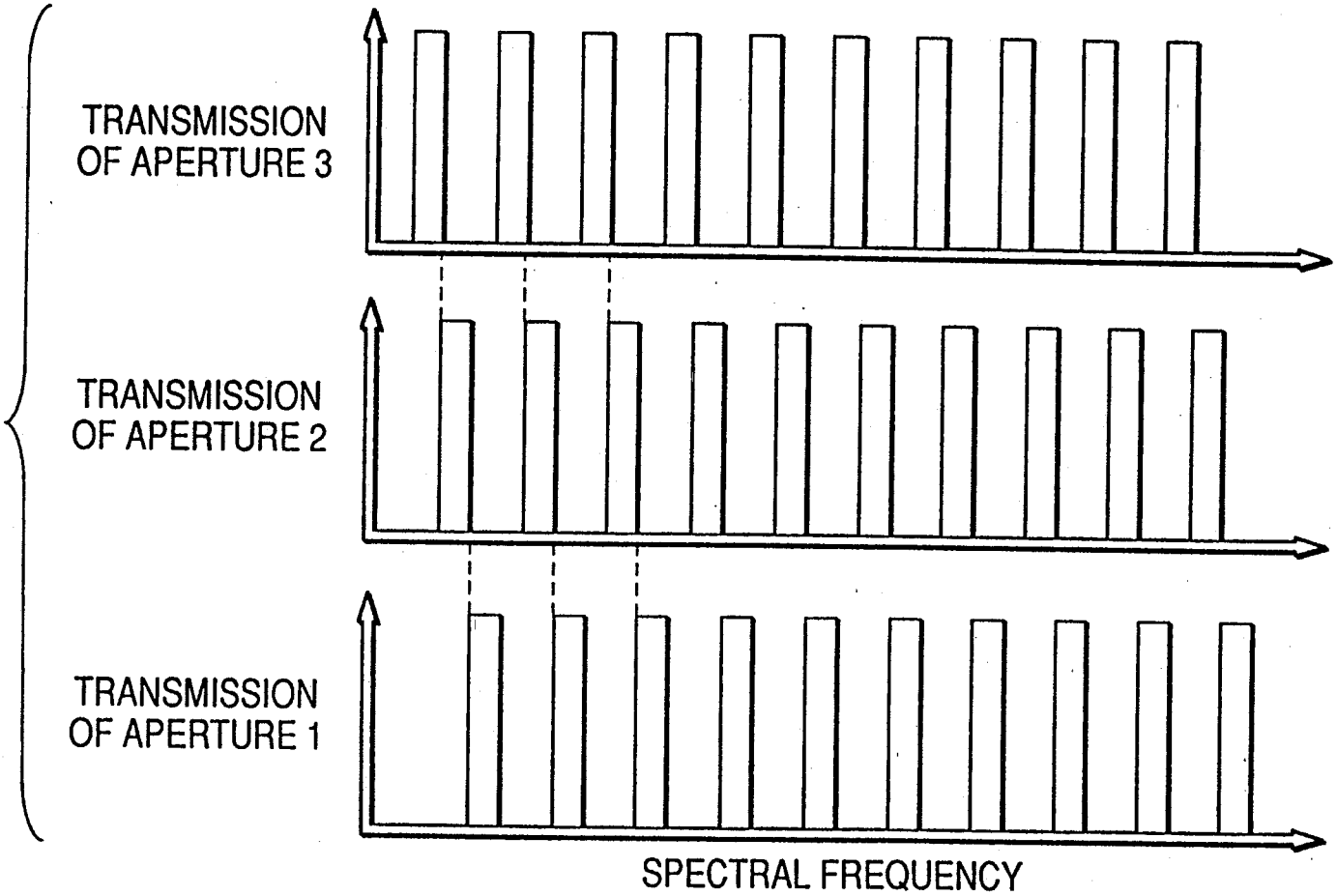
FIG. 25 illustrates the spectral characteristic of the visual filter elements of the array of FIG. 24 and of the segments of the filter wheel of FIG. 23B.

FIGS. 23–25 illustrate a fourth embodiment 250 of the present invention. The fourth embodiment closely parallels the third embodiment described above, but the individual apertures of the cellular array of apertures 266 are selected in a different way. The image source 204 and the image display 50 are fixed relative to each other and not movable physically relative to each other with only the selecting of apertures 266 producing the light emitting points of the display image. In the fourth embodiment, the apertures contained within light valve cell 256 are activated or selected by a characteristic of the light used to back-light the liquid crystal display 204. The individual pixels 208 are optically aligned with a single light valve 256. To this end, color filter 262 contains a plurality of color filter segments 258 as illustrated in FIG. 23B. The numbers contained within each of the color segments 258 correspond to the numbers contained within an individual aperture 266 as illustrated in FIG. 24. The color filter segments pass different color bands, as illustrated in by the graphs in FIG. 25, with each of the pass characteristics which are associated with a particular segment generally having a comb-like filter characteristic with the individual pass characteristics offset from the pass characteristics of other filters. Thus each filter segment 258 ideally transmits or passes a unique set of colors. As illustrated in FIG. 25, the pass bands of aperture 3 are offset in frequency or color from the pass bands of segment 2, which are in turn offset from the pass bands of segment 1. Since each filter segment passes light within a number of bands spread over the visible spectrum, the filtering process does not significantly alter the perceived color of the transmitted light. As a result, utilizing color multiplexing to selectively pass light does not significantly effect the color of the displayed image produced by the image display. The numbered aperture elements 266 of each light valve cell 256 have the same filter characteristics as the numbered segments 258 of color filter wheel 262.

A particular aperture 266 is selected (open) by changing the frequency components of the light imaged upon the image source 204. The aforementioned filtered characteristic, as illustrated in FIG. 25, produced by rotation of the filter wheel 262 produces the aforementioned switching pattern. The filtering of the light produced by the light source 210 by a particular segment 258 of the filter wheel 262 produces a frequency characteristic which matches the transmission characteristic of the aperture 266. Thus aperture 1 of light valve 256 transmits the light from the image source 204 to the image display plane 54 to produce apparent motion of the array of light emitting points as described with the other embodiments of the invention. The filter wheel 262 rotates in synchronism with the selective opening of the successive apertures 266 in the numbered sequences as illustrated in FIG. 24 with a single rotation of the wheel corresponding to a single repeated pattern producing apparent motion of the array of light emitting points. The information displayed by the image display 50 under the control of the system controller 62 is synchronized with the rotation of the wheel 262. Each aperture 266 of the array of array of apertures within a light valve respectively corresponds to a different position of a single light emitting point of the image display 50 with each aperture having a frequency pass band matching only one comb filter characteristic of one of the filter segments 258. A speed sensing device such as a tachometer may be utilized for providing speed and position information regarding each of the segments 258 of the filter wheel 262 to permit the system controller 62 to synchronize the display of information as described above.

In the fourth embodiment, the image source 204 comprises the light source 210, the filter wheel 262 and the array 208 of pixels. The actuator 50 comprises the array of light valves 256 having the individual apertures 266.

The system controller 62 synchronizes selection of the filter characteristic and control of the pixels so that a single filtration and control of the pixels occurs with each field of the image.

The primary benefit of the embodiments of FIGS. 21–25 is that there is no actual motion required of a mask. In the third embodiment, the electronic addressing of the elements of the light value cell takes the place of movement of the mask. In the forth embodiment, the rotational motion of the color wheel 262 replaces the more complex motion required by the mask 60 in the other embodiments of the invention described above. In applications where a FOB 48 is used to convey imagery to a helmet mounted display, this type of color multiplexing can be used to eliminate all moving components (primarily the mask) from the helmet region to create a passive helmet display system which is light, resistant to shock and acceleration forces and does not require synchronization as a result of synchronization between the image fields and the color wheel being performed remotely from the helmet. Since each aperture responds to a range of colors, as shown by the comb-like transmission characteristic illustrated in FIG. 25, color imagery can be displayed.

Figure 26:
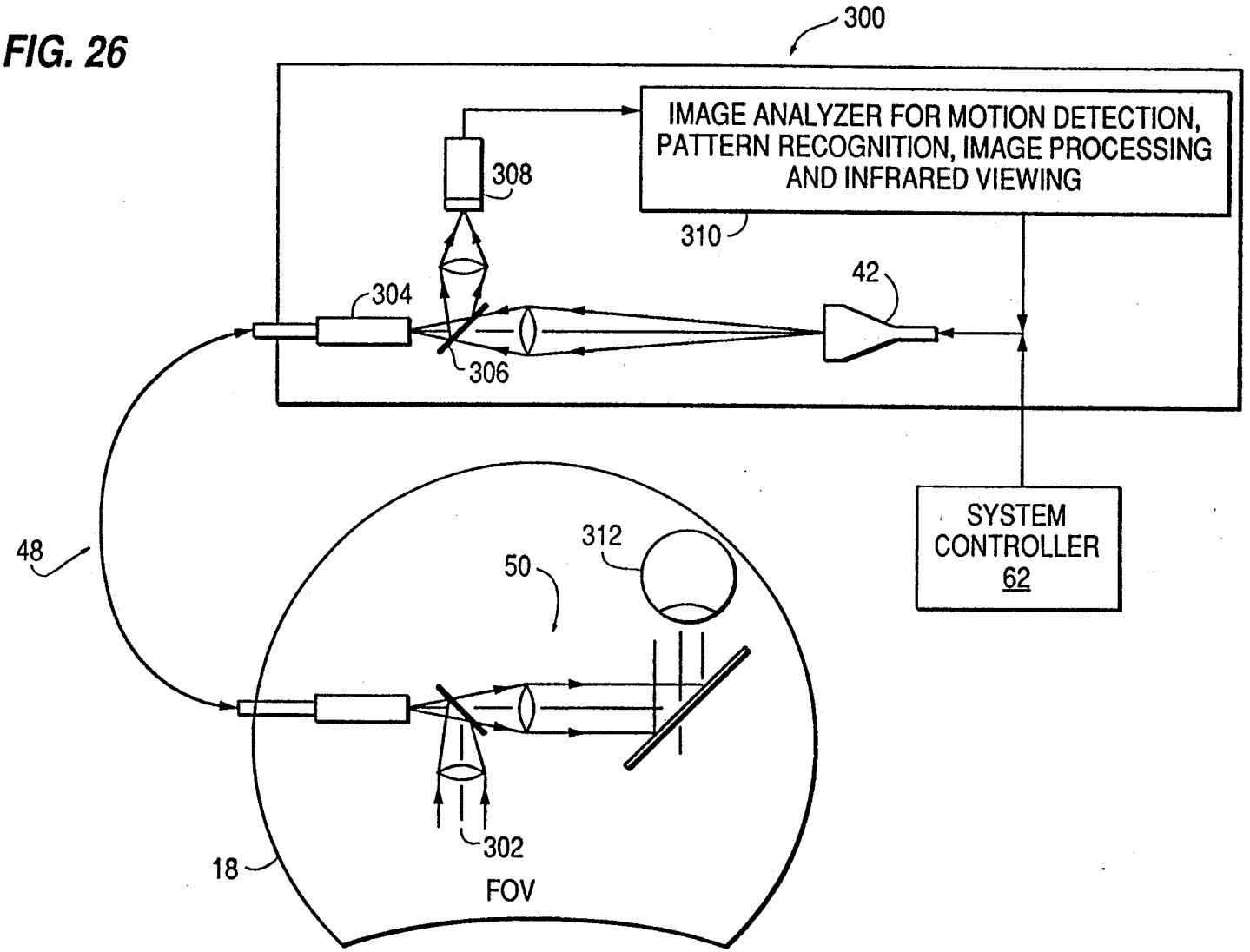
FIG. 26 illustrates a preferred application of the present invention in a helmet mounted heads-up display in which the fiber optic bundle is used for duplex transmissions of imagery to and from an image source position for displaying the field of view of the displayed image to a wearer of the helmet and further the transmission of imagery from the field of view of the helmet back to the image source for image analysis for motion detection, pattern recognition, image processing or infrared viewing.

FIG. 26 illustrates a fifth embodiment 300 of the present invention which is utilized in a helmet mounted head-up display. The embodiment of FIG. 26 differs primarily from the embodiment of FIG. 2 in that in addition to the operation described above in conjunction with FIG. 2, image information is relayed through the FOB 48 from an input optical image 302 to the helmet 18 to the image source which is illustrated for purposes of simplicity as a single CRT with it being understood that the image source may be identical to that illustrated in FIG. 2. The input image 302 is relayed inward from the FOV to the helmet 18 and transmitted to the image source which includes a single CRT 42. The end 304 of the FOB outputs the transmitted image which is imaged upon a half-silvered mirror 306 which reflects a portion of the image to an image sensor such as a CCD array 308. The output of the image sensor 308 is coupled to an image analyzer 310. The image analyzer may have diverse image analysis processing capabilities, such as motion detection, pattern recognition, image processing and analysis of infrared images within the input image 302 to provide an analysis of the input image from the FOV of the helmet 18. The image analyzer 310 generates an image in response to the analysis of the image produced by the sensor 308 which is applied to the image source 42 for transmission back to the image display 50 in the helmet 18 through the FOB 48. The transmitted image from the image source is an enhancement of an object which is either visible or not visible from the FOV of the helmet. For example, the human eye 312 may not possess sufficient sensitivity to pickup motion of an object within the input image 302. Additionally, the human eye 312 may not recognize certain characteristic patterns such as the telltale outline of objects which are encountered by wearers of the helmet such as aircraft. Finally, the image analyzer 310 may provide visualization of images of objects emitting light at wavelengths outside of the visible light spectrum of the human eye such as a heat signature of an aircraft. Another advantage of the embodiment 300 of FIG. 26 is that the input image 302 permits the determination of the direction of the FOV apparent to the human eye 312 of the wearer of the helmet 18. This permits the control of systems of an aircraft which are dependent upon knowing in which direction a pilot of an aircraft is looking. Recognition of standard patterns which are determined by the turning of the head of a pilot may be recognized by the image analyzer 310 permitting the generation of images warning of actions to be taken which are dependent upon the direction in which a pilot is looking which influences the image to be displayed by the image display 50. The enhancement which may be provided to the wearer of the helmet 18 in response to processing by the image analyzer 310 may be varied to have diverse forms, such as providing delineation of the object by drawing a box around the object, etc. It should be understood that the actuator 52 has been omitted from the image display 50 and further that the detail of the image display has been simplified from that illustrated in FIG. 2 for purposes of simplifying the illustration with it being understood that the system of FIG. 2 may be utilized in the fourth embodiment.

Figure 27:
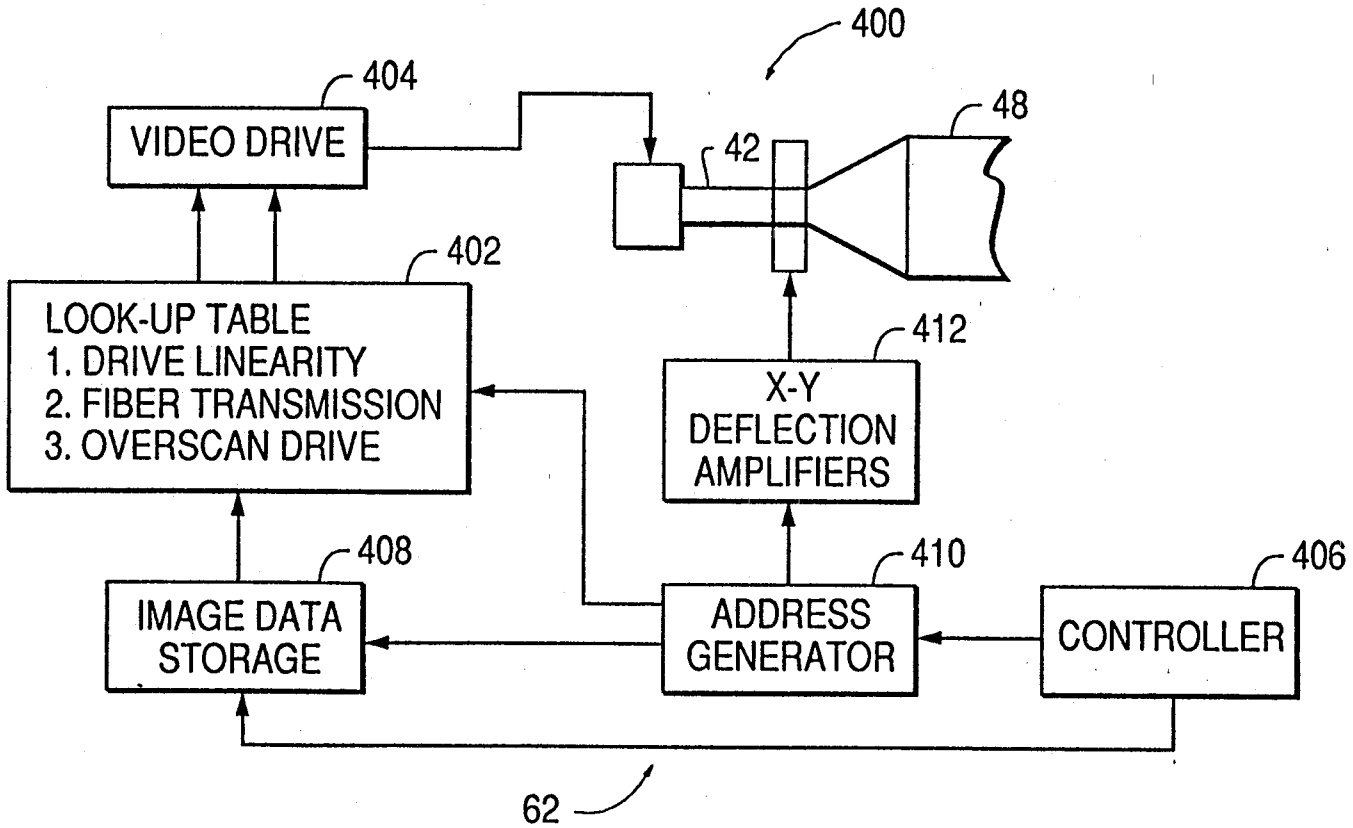
FIG. 27 illustrates a system for correcting for the transmission characteristics of individual fibers in a fiber optic bundle utilizing at least a stored transmission characteristic for each of the fibers of the bundle to correct for variation in the transmission characteristics of individual fibers from the image source to the image display utilized with the present invention.

FIG. 27 illustrates a system 400 which is used by the image display of the type illustrated in FIGS. 2 and 26 to compensate for the effects of variable optical transmissivity of the individual fibers 63 of the FOB 48 or to otherwise provide compensation for characteristics of the transmission of the FOB. The controller 62 includes a look up table 402 storing for each pixel of the image source data to be used for controlling the display produced by the image source 42 which is illustrated as a CRT. Each addressable pixel location contained in a look up table 402 contains information controlling beam drive linearity for correlating beam current to produce a desired level of light, fiber transmission to normalize transmission of light by the FOB 48 and whether a particular pixel associated with a fiber requires overscanning as described above in conjunction with FIG. 20. The look up table 402 has an array of storage locations having the same number of location as the pixels of the image source 42. The information stored in each of the addressable locations of the drive linearity array may be stored as a digital word, such as a word having 8 bits which permits the selection of 256 levels of current for driving the phosphor of the CRT of the image source. The digital word is converted by a digital-to-analog converter into an analog control value which is applied the video drive 404 which controls the generation of the beam current. The addressable array of the look up table for performing fiber transmission correction stores a characteristic which is a multiplicative factor which is used to control a potential which is applied to the cathode of the image source 42. Each location of the array storing a multiplicative factor for correcting the transmissivity of a single fiber 63 within the FOB 48 functions to normalize the transmissivity of the FOB to provide a uniform transmission characteristic throughout the spatially modulated image produced by the image source. The individual output from a storage location within the fiber transmission array controls the potential applied to the video drive 404 and is produced by a second digital-to-analog converter which controls the cathode potential. The fiber transmission control is used to select the range of current magnitude produced by the cathode. The individual current within the range is controlled by the level specified by the drive linearity. The look-up table 402 also stores a single bit associated with each of the pixels of the image source and corresponding fibers 63 of the FOB 48 for indicating those fibers which are defective which require overscanning in FIG. 20 as described above. Controller 406 may be any device such as a work station or other source of virtual image data which outputs data for storage in an image data storage 408 which functions as a frame buffer for storing successive fields of data which are displayed by the image source 42. The controller 406 also sequences address generator 410 through the matrix of addressable locations which correspond to the pixels of the image source 42 and the fibers of the FOB 48. The address generator 410 supplies an address to the image data storage 408 for sequentially reading out the stored data provided by the controller 406 in a synchronous manner so that the appropriate data is applied with drive linearity correction to modulate the beam of the cathode ray tube of the image source 42. Additionally, the address generator 410 is coupled to the look-up table 402 for controlling the generation of the multiplicative factor for controlling the fiber transmission characteristic in a manner which is synchronous with the driving of the individual pixels by the image source 42. The address generator 410 also controls X-Y deflection amplifiers 412 which cause the beam of the cathode ray tube of the image source 42 to sweep out the individual pixels within each field of information coupled to the fiber optic bundle 48.

Figure 28:
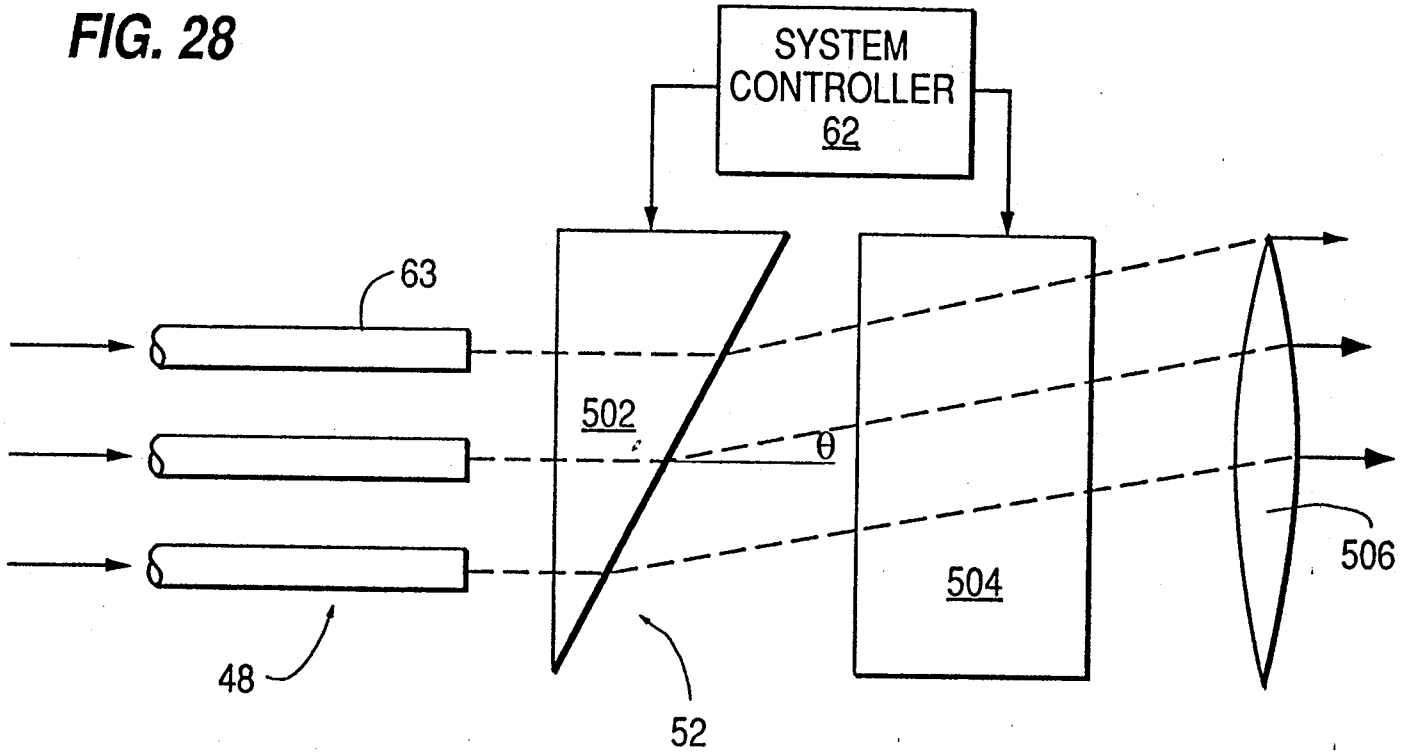
FIG. 28 illustrates an actuator utilizing refraction of the fields of an optical image produced by the image source to produce the matrix of light emitting points as viewed from the field of view of the image display.

FIG. 28 illustrates an actuator 52 which relies upon refraction of an optical image produced by the image source which may be any of the image sources utilized by the present invention. As illustrated, the actuator is comprised of a first element 502 which refracts the output image produced by the FOB 48 through an angle $\theta$ and a second element 504 which refracts the output image from the first element 502 through an angle into and out of the plane of FIG. 28 through an angle (not illustrated) to cause motion of the array of light emitting points through the positions of the repeating pattern as discussed above in conjunction with FIGS. 11–13. It should be understood that the actuator of FIG. 28 does not require the presence of a FOB 48. Additionally, a mask 60 may be used in conjunction with the fiber optic bundle as illustrated in FIG. 2. The individual elements 502 and 504 utilize well known materials such as lithium niobate, lithium tantalate, potassium dihydrogen phosphate (KDP), or ammonium dihydrogen phosphate (ADP) which have a variable index of refraction as a function of applied voltage. The system controller 62 functions to apply the appropriate voltages to the elements 502 and 504 to cause the array of light emitting points to sequentially move through the positions as described above in conjunction with FIGS. 11–13. A lens 506 may be used to focus the refracted image onto a mirror or other structure associated with a helmet mounted heads-up display such as that illustrated in FIG. 2.

Various embodiments of the present invention have been described which utilize a FOB 48. It should be understood that the FOB 48 may be coherent in which the location of an individual fiber in a cross-sectional plane of the input and the output is identical or non-coherent in which the location of an individual fiber is different between the input plane and the output plane. When non-coherent fibers are utilized, the addressing of subsequent pixels by the image source must be controlled so that the beam of the cathode ray tube or other image source is appropriately indexed to the particular fiber on the input side which will produce a modulated light value at the light emitting point on the output to produce a synchronous display between the input image produced by the image source and the output image at the FOV produced by the image display. A non-coherent FOB would not produce a useful image without the aforementioned synchronization.

EXAMPLE 1

A high definition 1024 line×1024 pixel image display is produced at the FOV of the image display. A 256 pixel×256 pixel image source is utilized. A 256×256 FOB 48 comprised of an array of 25 micron diameter fibers is utilized. The image source is a CRT capable of displaying a 256 line×256 pixel image. The multiplex factor which is the number of fields of information which is generated by the image display 50 which corresponds to the number of addressable positions through which the array of light emitting points is indexed is 4×4. Thus, the 256×256 CRT image source multiplied by the multiplex factor of a 4×4 matrix, such as that illustrated in FIGS. 11 and 12, as discussed above, results in a 1024×1024 pixel display image as viewed from the FOV. The 256 row×256 element FOB is 0.256 inches×0.256 inches in size as a result of the 0.001 inch fiber diameter.

The electronic characteristics and timing are as follows. The final image which is viewed from the FOV 48 by the user at the output end of the FOB after all multiplexing is produced is similar to that produced by standard CRT images with a 32 Hz. image refresh rate. The resultant video bandwidth of the output image is equal to the product of the number of pixels in the row and column directions which is equal to 1024×1024 times the refresh rate which is equal to a 32 MHz. image bandwidth.

As a result of the pixels within the final image being mapped 1:1 on the CRT of the image source, this is also the video bandwidth required for the image source drive or the CRT bandwidth. During each image refresh (1/32 sec.), the FOB 48 must assume each of the 16 physical positions which comprise the positions produced by the actuator as illustrated in FIGS. 11 and 12. For each of the 16 positions of the output end of the FOB 48, the CRT image source must present a complete 256 line×256 pixel image in order to drive each of the 256×256 elements of the FOB. Thus, the CRT frame rate is equal to 16 fields per field image times 32 images/second which equals 512 Hz. The distinction between full-image refresh (32 Hz.) and CRT frame rate (512 Hz.) is due to the FOB 48 positioning produced by the actuator. The CRT line rate, or horizontal deflection rate, is equal to the number of CRT frames per second, which is equal to 512, times the number of CRT lines per frame which is equal to 256, and thus the CRT line rate equals 128 KHz.

The fast refresh and natural interlace or sequential fields should reduce flicker and allow for faster image updating as a result of there being no need to await image refresh to change image content.

A faster lifetime phosphor, such as P31, P11 or P4, may be required to accommodate the faster CRT refresh.

The motion characteristics of the FOB 48 produced by the actuator 52 are such that the end of the FOB must be moved through 16 multiplexing locations during the production of an image comprised of 16 fields in one refresh period of 1/32 sec. If normal CRT deflection convention is applied to the motion of the FOB 48 with the slow deflection rate being assigned to the vertical and the fast deflection rate being assigned to the horizontal, the vertical frequency of the FOB 48 is 32 Hz. and the horizontal rate is 128 Hz.

For this example, with a multiplex factor of 16 and a fiber diameter of 0.001 inch, the fiber optic bundle 48 moves with a total amplitude of +/−0.002 inches horizontally and +/−0.002 inches vertically. This small amplitude is compatible with a number of drive technologies, such as piezoelectric deflectors and electroactive optical materials having a variable refraction such as those described above. Other technologies for implementing the actuator may be utilized. This small amplitude of motion required of the fiber bundle is one primary advantage of the invention.

The choice of 16 fields as a multiplex factor is believed to be conservative. Larger multiplex factors can lead to a smaller FOB array or to larger final images or more highly resolved final images or smaller CRT diameter or some combination of these above factors. The penalty for a higher multiplex factor is a higher CRT deflection rate and a higher FOB deflection rate, and a higher FOB deflection amplitude unless the FOB fiber diameter is decreased.

The present invention reduces the weight of a helmet mounted fiber optic bundle. The following calculations illustrate the weight reduction. The FOB from the helmet to the user's shoulder, which supports the weight of the remaining fiber bundle, is equal to a distance of approximately 8 inches. A voice coil deflector is utilized to implement the actuator 52 along each axis. However, it should be understood that other drive technologies may offer applications specific design advantages. A thin mask to correct FOB alignment inaccuracies, such as the mask 60 of FIG. 4 is utilized. Mechanical brackets are used to hold the drive elements and the FOB 48. The estimated weight of the FOB 48 is equal to 9.5 grams for cable weight and a 50% additional factor for cable shielding, bringing the total to 14.25 grams. The voice coil drives have an estimated weight of 25 grams for each axis for a total of 50 grams. The mask 60, which is made of a thin glass or plastic, which is 2.00 mm. thick×2.5 cm. square, has an estimated weight of 3 grams. The mask has the additional advantage of permanently mounting or fixing the location of the ends of the individual fibers 63 of the FOB 48. An estimated weight of mechanical mounting brackets is 27 grams. The total estimated weight is 94.3 grams which provides a significant weight reduction when compared to prior art helmet mounted heads-up displays which utilize non-multiplexed technologies in which a fiber within the FOB is assigned to each pixel of the image source and image display.

While the invention has been described in terms of its preferred embodiments, it should be understood that numerous modifications may be made thereto without departing from the spirit and scope of the invention as defined in the appended claims. It is intended that all such modifications fall within the scope of the appended claims.

I claim:

1. An optical display system comprising:

an image source for generating an image which includes a plurality of fields sequentially displayed by the image source to form the image with a two-dimensional array of pixels forming each field and the fields having a spatially modulated light intensity; and an image display, coupled to the image source, for displaying the fields and including for each field a two-dimensional array having a fixed number of light emitting points with at least two light emitting points being disposed along each dimension of the two-dimensional array and each light emitting point being spaced apart from adjacent light emitting points by a fixed distance and an actuator for moving the light emitting points in unison in a repeated pattern relative to a field of view of the displayed image with motion of each of the light emitting points in two-dimensions during the repeated pattern delineating an area which is a fraction of an area of the displayed image produced by the image display and moving of the light emitting points through successive positions of the repeated pattern being synchronized with the successive display of individual fields by the image source.

2. An optical display system in accordance with claim 1 wherein:

the motion of the light emitting points in each of the two dimensions defining the area of the repeated pattern is through a plurality of the successive positions in displaying the fields of the image.

3. An optical display system in accordance with claim 2 wherein:

the image source comprises a cathode ray tube which modulates the light intensity of the spatially modulated fields.

4. An optical display system in accordance with claim 3 wherein:

each field is comprised of an n×m array of pixels which are sequentially scanned by the cathode ray tube wherein n is a number of pixels of a field extending in a first dimension and m is a number of pixels extending in a second dimension.

5. An optical display system in accordance with claim 2 wherein:

the area delineated by the repeated pattern has a length of ax and a width of bx with a cross-sectional area of $abx^2$ with a being an integer equal to or greater than 2, b being an integer equal to or greater than 2 and x being dimension of the light emitting points with a position of each light emitting point during movement of the array of points through the repeated pattern by the actuator moving a distance equal to x along the length or along the width in synchronism with successive fields displayed by the image source.

6. An optical display system in accordance with claim 2 further comprising:

a fiber optical bundle having a plurality of individual fibers for transmitting light from the pixels of the image source to the light emitting points of the image display with an individual optical fiber of the bundle which is optically coupled to a pixel transmitting light between a pixel and a light emitting point.

7. An optical display system in accordance with claim 6 wherein:

the actuator moves an end of the fiber optic bundle coupled to the image display with the individual fibers of the end being spaced apart by the fixed distance.

8. An optical display system in accordance with claim 6 wherein:

the actuator refracts light emitted from ends of the fiber optical bundle to move the light emitting points through the repeated pattern.

9. An optical display system in accordance with claim 6 wherein:

the image display is part of a helmet mounted head-up display movable relative to the image source and provides images to be visually observed by a person wearing the helmet.

10. An optical display in accordance with claim 9 wherein:

the fiber optic bundle transmits an input optical image to the helmet back to the image source; and further comprising an image analyzer for analyzing the input image transmitted by the fiber optic bundle and controlling transmitting an image from the image source which was generated in response to an analysis of the transmitted image by the image analyzer.

11. An optical display in accordance with claim 10 wherein:

the input image is inputted from an optical system optically coupled to a field of view of the helmet; and the transmitted image from the image source is an enhancement of an object in the field of view of the helmet.

12. An optical display system in accordance with claim 11 wherein:

the input image includes an infrared image of the field of view of the helmet; and the transmitted image from the image source enhances the infrared image.

13. An optical display system in accordance with claim 6 further comprising:

a mask having an array of spaced apertures with an individual aperture being optically coupled to an individual fiber so that light emitted from one optical fiber passes through the aperture to provide a spacing between the light emitting points as viewed from the field of view which is defined by a spacing between the apertures; and the mask is moved by the actuator through the repeated pattern to display the image.

14. An optical display in accordance with claim 13 wherein:

a dimension of the apertures is smaller than a dimension at an end of each fiber which is attached to the image display.

15. An optical display system in accordance with claim 2 wherein the actuator comprises:

at least one pair of piezoelectric elements for moving the light emitting points along orthogonal axes to produce the repeated pattern.

16. An optical display system in accordance with claim 2 wherein the actuator comprises:

at least one pair of electromagnetic coils for moving the light emitting points along orthogonal axes to produce the repeated pattern.

17. An optical display system in accordance with claim 2 wherein the actuator comprises:

at least one electrically activated light refractor optically coupled to a light output of the light emitting points at the image display for refracting the light output along orthogonal axes to produce the repeated pattern.

18. An optical display system in accordance with claim 2 wherein the actuator comprises:

at least one mirror optically coupled to a light output of the light emitting points at the image display for reflecting the light output along orthogonal axes to produce the repeated pattern.

19. An optical display system in accordance with claim 2 wherein the actuator comprises:

at least one lens optically coupled to a light output of the light emitting points at the image display for deflecting the light output along orthogonal axes to produce the repeated pattern.

20. An optical display system in accordance with claim 2 wherein the image source comprises:

a plurality of image producing devices with each device providing a part of each field with the parts being spatially non-overlapping.

21. An optical display system in accordance with claim 2 wherein the image source comprises:

a plurality of image producing devices with each device providing a different input image with the input images being spatially overlapping.

22. An optical display system in accordance with claim 21 wherein the input images comprise:

different colored images which are combined to produce a color displayed image of a single field of view.

23. An optical display system in accordance with claim 6 wherein the image display further comprises:

a mechanism for sensing a position of the fiber optic bundle at an end optically coupled to the light emitting points; and wherein the actuator is responsive to the sensed position for controlling movement of the actuator through the repeated pattern.

24. An optical display system in accordance with claim 23 wherein:

the mechanism for sensing comprises at least one input fiber of the bundle coupled to a light source and having an output which outputs light onto a target area which is fixed in position with respect to a viewing field of the display having reflective areas and at least one output optical fiber having an input disposed adjacent to the output of the input fiber having an output coupled to a photosensitive device with an output from the photosensitive device occurring when the light output of the at least one input fiber projects light which is reflected by one of the reflective areas to the input of the at least one output optical fiber which is processed by the actuator to provide a signal indicating the position of the light emitting points to control the repeated pattern.

25. An optical display system in accordance with claim 6 comprising:

a look-up table storing data of at least a transmission characteristic of individual fibers which are optically coupled to a pixel of the image source and a single light emitting point of the image display; and wherein the image source is responsive to the stored data to control a light intensity of light which is outputted by the image source to each fiber optically coupled to a pixel to provide at least a uniform light transmission characteristic for the fibers optically coupled to the light emitting points.

26. An optical display system in accordance with claim 25 wherein:

the at least one stored characteristic includes a multiplicative factor which is used to control the light intensity of the pixels to at least normalize the transmissivity of the fiber bundle.

27. An optical display system in accordance with claim 2 wherein the image display further comprises:

a mask having an array of spaced apertures which are spaced with an individual aperture being optically coupled with an individual pixel so that light emitted from one pixel passes through the aperture to the field of view to provide spacing between the light emitting points as viewed from the field of view which is defined by spacing between the apertures; and the mask is moved by the actuator through the repeated pattern to display the image.

28. An optical display system in accordance with claim 27 wherein:

a maximum dimension of the apertures is smaller than a maximum dimension of a pixel optically aligned with the aperture.

29. An optical display system in accordance with claim 28 wherein:

the image source comprises a back lighted liquid crystal display.

30. An optical display system in accordance with claim 28 wherein:

the image source comprises an electroluminescent panel.

31. An optical display system in accordance with claim 28 wherein:

the image source comprises a CRT.

32. An optical display system in accordance with claim 2 wherein:

the image source comprises an array of light emitting diodes.

33. An optical display system in accordance with claim 2 wherein:

the image source and the image display are not movable relative to each other with only the actuator producing relative motion of the light emitting points with respect to the field of view.

34. An optical display system in accordance with claim 2 wherein:

the image source and the image display are fixed relative to each other and are not movable physically relative to each other.

35. An optical display system in accordance with claim 34 wherein the actuator comprises:

an array of light valves disposed between the image source and the field of view with a number of light valves being equal to the fixed number of light emitting points and with individual light valves being aligned with a single pixel and containing an array of apertures which each respectively correspond to a different position of a single light emitting point with each aperture being switchable to pass light from the display pixel; and the system further comprising a controller for synchronizing the display of the fields of the image and the switching of the apertures to produce movement of the light emitting points through the repeated pattern with each successive position of a light emitting point corresponding to a different field of the image source.

36. An optical display system in accordance with claim 34 wherein:

the image source comprises a light source, a filter which sequentially filters light produced by the light source with each sequential filtration filtering the light with a comb filter-like characteristic having spaced apart pass band characteristics with each sequential filtration having a different pass band characteristic with all of the filtrations collectively passing a spectrum of light comprising the image and an array of pixels being controlled by a system controller to pass the sequential filtration of light through the pixels to produce the image; and the actuator comprises an array of light valves disposed between the image source and the field of view with individual light valves being aligned with a single pixel and containing an array of apertures which each respectively correspond to a different position of a single light emitting point with each aperture having a frequency pass band characteristic matching only one comb filter characteristic of one of the sequential filtrations; and wherein a system controller synchronizes selection of the filter characteristics and control of the pixels so that a single filtration and control of the pixels occurs with each field of the image.

37. An optical display system in accordance with claim 36 wherein:

the filter is a rotating filter wheel having a plurality of sectors with each sector having a different comb filter pass band characteristic.

38. A method of optical display of an image comprising:

generating an image including a plurality of fields which are sequentially displayed to form an image with a two-dimensional array of pixels forming each field having a spatially modulated light intensity;

optically coupling the fields of the image to a two-dimensional array of a fixed number of at least two light emitting points spaced apart by a fixed distance displaced along each dimension of the two-dimensional array; and moving the light emitting points in unison in two dimensions in a repeated pattern relative to a field of view of the displayed image with movement of each light emitting point in two dimensions during the repeated pattern delineating an area which is a fraction of an area of the displayed image produced by the display of the image at the field of view and moving the light emitting points through successive positions of the repeated pattern being synchronized with the successive display of individual fields by the image source.

39. A method of optical display in accordance with claim 38 wherein:

the motion of the emitting points in each of the two dimensions defining the area of the repeated pattern is through a plurality of the successive positions in displaying the fields.

40. A method in accordance with claim 29 wherein:

the area delineated by the repeated pattern has a length of ax and a width of bx with a cross-sectional area of $abx^2$ with a being an integer equal to or greater than 2, b being an integer equal to or greater than 2 and x being a dimension of the light emitting points with a position of each light emitting point during movement of the array of points through the repeated pattern by the actuator moving a distance equal to x along the length or along the width in synchronism with successive fields displayed by the image source.

41. A method in accordance with claim 39 wherein:
a fiber optic bundle having a plurality of individual fibers transmits light from each of the pixels to the light emitting points with an individual optical fiber of the bundle which is optically coupled to a pixel transmitting light between a pixel and a light emitting point.

42. A method in accordance with claim 41 wherein:
an end of the fiber optic bundle coupled to the light emitting points is moved through the repeated pattern with the individual fibers of the end being spaced apart by the fixed distance.

43. A method in accordance with claim 41 wherein:
light emitted from each fiber of the fiber optical bundle is refracted to move the light emitting points through the repeated pattern.

44. A method in accordance with claim 39 wherein:
the fiber optic bundle transmits light from an image source to a helmet mounted head-up display which is movable relative to an image source and provides images to be visually observed by a person wearing the helmet.

45. A method in accordance with claim 44 further comprising:
transmitting an input optical image to the helmet through the fiber optic bundle to the image source;
analyzing the transmitted input image; and
transmitting from the image source through the fiber optic bundle to the helmet an image produced in response to the analyzed input image.

46. A method in accordance with claim 45 wherein:
the input optical image is optically coupled to a field of view of the helmet; and
the transmitted image from the image source is an enhancement of an object in a field of view of the helmet.

47. A method in accordance with claim 46 wherein:
the input image includes an infrared image from the field of view of the helmet.

48. A method in accordance with claim 41 further comprising:
transmitting light from the fiber optic bundle through an array of apertures which are spaced in a mask attached to an end of the fiber optic bundle with the individual apertures corresponding to the individual light emitting points and providing spacing between the light emitting points; and
moving the mask through the repeated pattern.

49. A method in accordance with claim 47 wherein:
a dimension of the apertures is smaller than a dimension of an end of each fiber which is attached to the mask; and
light transmitted through each aperture to the field of view is restricted by the aperture.

50. A method in accordance with claim 39 wherein:
the moving of the light emitting points in unison in the repeated pattern is along orthogonal axes.

51. A method in accordance with claim 50 wherein:
the movement along orthogonal axes is produced by at least one control element.

52. A method in accordance with claim 39 wherein:
the image is comprised of a plurality of spatially non-overlapping parts provided from different image producing devices.

53. A method in accordance with claim 39 wherein:
the image is comprised of spatially overlapping parts provided from different image producing sources.

54. A method in accordance with claim 39 wherein:
the image is comprised of different colored images provided from different image producing sources which are combined to produce a color displayed image.

55. A method in accordance with claim 41 further comprising:
sensing a position of the array of light emitting points; and
controlling the movement of the array of light emitting points through the repeated pattern in response to the sensed position.

56. A method in accordance with claim 39 further comprising:
controlling a light intensity of the pixels in response to a look up of stored data of at least a transmission characteristic of individual fibers which are optically coupled to a pixel and to a light emitting point to provide at least a uniform transmission characteristic for the optical fibers coupled between the pixels and the light emitting points.

57. A method in accordance with claim 56 wherein:
the stored characteristic is at least a multiplicative factor which is used to control the light intensity of the pixels to at least normalize the transmissivity of the fibers.

58. A method in accordance with claim 39 wherein:
the light emitting points are produced by passing light from each pixel through an associated aperture in a mask having spaced apertures optically coupled to the field of view so that light emitted from one pixel passes through one aperture to provide spacing between the light emitting points as viewed from the field of view which is defined by a space between apertures; and
the mask is moved through the repeated pattern to display the image.

59. A method in accordance with claim 58 wherein:
a maximum dimension of the apertures is smaller than a maximum dimension of a pixel optically aligned with the aperture.

60. A method in accordance with claim 39 wherein:
movement of the light emitting points is produced by relative motion between the light emitting points and the field of view.

* * * * *